US009972901B2

(12) United States Patent
Lavin et al.

(10) Patent No.: US 9,972,901 B2
(45) Date of Patent: May 15, 2018

(54) ANTENNA ELECTROMAGNETIC RADIATION STEERING SYSTEM

(71) Applicant: The Boeing Company, Chicago, IL (US)

(72) Inventors: Ronald O. Lavin, Gilbert, AZ (US); Michael M. LoRé, Mesa, AZ (US)

(73) Assignee: The Boeing Company, Chicago, IL (US)

( * ) Notice: Subject to any disclaimer, the term of this patent is extended or adjusted under 35 U.S.C. 154(b) by 506 days.

(21) Appl. No.: 14/518,083

(22) Filed: Oct. 20, 2014

(65) Prior Publication Data

US 2017/0084988 A1 Mar. 23, 2017

(51) Int. Cl.

| | |
|---|---|
| ***H01Q 1/42*** | (2006.01) |
| ***H01Q 19/10*** | (2006.01) |
| ***H01Q 15/16*** | (2006.01) |
| ***H01Q 3/14*** | (2006.01) |
| ***H01Q 3/20*** | (2006.01) |

(52) U.S. Cl.

CPC ..... *H01Q 1/428* (2013.01); *H01Q 1/42* (2013.01); *H01Q 3/14* (2013.01); *H01Q 3/20* (2013.01); *H01Q 15/16* (2013.01); *H01Q 19/10* (2013.01)

(58) Field of Classification Search

CPC H01Q 1/428; H01Q 3/12; H01Q 3/14; H01Q 3/16; H01Q 3/20; H01Q 3/22

See application file for complete search history.

(56) References Cited

U.S. PATENT DOCUMENTS

| | | | | |
|---|---|---|---|---|
| 3,045,236 | A * | 7/1962 | Colman | H01Q 1/428 343/705 |
| 3,638,502 | A | 2/1972 | Leavitt et al. | |
| 4,821,043 | A * | 4/1989 | Leavitt | H01Q 1/428 343/765 |
| 5,765,043 | A | 6/1998 | Tyler | |
| 6,897,809 | B2 | 5/2005 | Carson et al. | |
| 7,928,924 | B1 * | 4/2011 | Hendrickson | H01Q 1/50 343/700 MS |
| 8,421,696 | B2 | 4/2013 | Lin et al. | |
| 8,890,765 | B1 * | 11/2014 | Dinh | H01Q 3/446 343/872 |
| 2005/0052325 | A1 | 3/2005 | Zigler et al. | |

OTHER PUBLICATIONS

Pelton et al.,"A Streamlined Metallic Radome," *IEEE Transactions on Antennas and Propagation*, pp. 799-803 (1974).

European Patent Office, Extended European Search Report, EP 15 19 0519 (dated Mar. 15, 2016).

* cited by examiner

*Primary Examiner* — Robert Karacsony

(74) *Attorney, Agent, or Firm* — Walters & Wasylyna LLC

(57) ABSTRACT

An antenna electromagnetic radiation steering system may include an antenna for emitting electromagnetic radiation, and a radome disposed adjacent to and at least partially enclosing the antenna, the radome including a window to pass electromagnetic radiation from the antenna to outside the radome, wherein electromagnetic radiation is directed based on a position of the window relative to the antenna.

20 Claims, 23 Drawing Sheets

ANTENNA ELECTROMAGNETIC RADIATION STEERING SYSTEM

FIELD

The present disclosure is generally related to radomes and, more particularly, to movable radomes having a window that is transparent to radio waves within a predetermined frequency band.

BACKGROUND

Vehicles, such as aircraft, marine vehicles, ground vehicles and spacecraft, typically use omnidirectional antennas at long wavelengths for long-range communications. Because these omnidirectional antennas are low gain, radio waves (e.g., a radio signal) transmitted by these antennas can be easily detected and/or intercepted due the indiscriminate radiation pattern of the radio waves. Therefore, high-directional antenna gain may be desirable for long-range communications.

High-gain antenna directionality may be accomplished using various techniques, such as utilizing a phased array of antennas, employing a dish antenna or horn antenna, or utilization of a large aperture directional antenna. However, a directional antenna at longer wavelengths is difficult to implement using traditional array, dish, or aperture techniques.

Antenna beam steering is typically accomplished using electronic weighting of antenna elements in a phased array or by mechanically steering the antenna, for example, using a gimbal, to provide a radio wave beam in a desired azimuth and elevation. However, use of such large aperture antennas and associated electronics and/or mechanical gimbals may be precluded from use on aerospace vehicles (e.g., aircraft) due to size and or weight.

Additionally, because antennas include delicate components that may be damaged when exposed to ambient conditions, antennas are often housed in radomes that prevent physical matter, such as debris, precipitation, moving air and the like, from coming into direct physical contact with antenna components. As such, a radome functions as a physical barrier to potentially damaging matter, while still permitting the propagation of electromagnetic radiation, particularly radio waves, to and from the protected antenna. Radomes are especially important to aircraft due to the aerodynamic drag and environmental sensitivity of antennas and electronic components.

Accordingly, those skilled in the art continue with research and development efforts in the field of high-gain directional antennas and radomes.

SUMMARY

In one embodiment, the disclosed antenna electromagnetic radiation steering system may include an antenna for emitting electromagnetic radiation, and a radome disposed adjacent to and at least partially enclosing the antenna, the radome including a window to pass electromagnetic radiation from the antenna to outside the radome, wherein electromagnetic radiation is directed based on a position of the window relative to the antenna.

In another embodiment, the disclosed radome for at least partially enclosing an antenna emitting electromagnetic radiation may include a window to pass electromagnetic radiation from the antenna to outside the radome, and a radome drive mechanism to rotate the radome about at least one axis of rotation.

In yet another embodiment, the disclosed method for controlling a direction of electromagnetic radiation emitted from an omnidirectional antenna may include the steps of: (1) enclosing the antenna within a radome including a window to pass electromagnetic radiation from the antenna to outside the radome, the window including at least one of an aperture formed in the radome, an electromagnetically transparent material formed in the radome, and a pattern of electromagnetically transparent features formed in the radome, (2) reflecting electromagnetic radiation directed away from the window back toward the window to increase the gain of the electromagnetic radiation passing through the window, and (3) rotating the radome about at least one axis of rotation to position the window relative to the antenna to direct electromagnetic radiation.

Other embodiments of the disclosed systems and method will become apparent from the following detailed description, the accompanying drawings and the appended claims.

DETAILED DESCRIPTION

Figure 1:
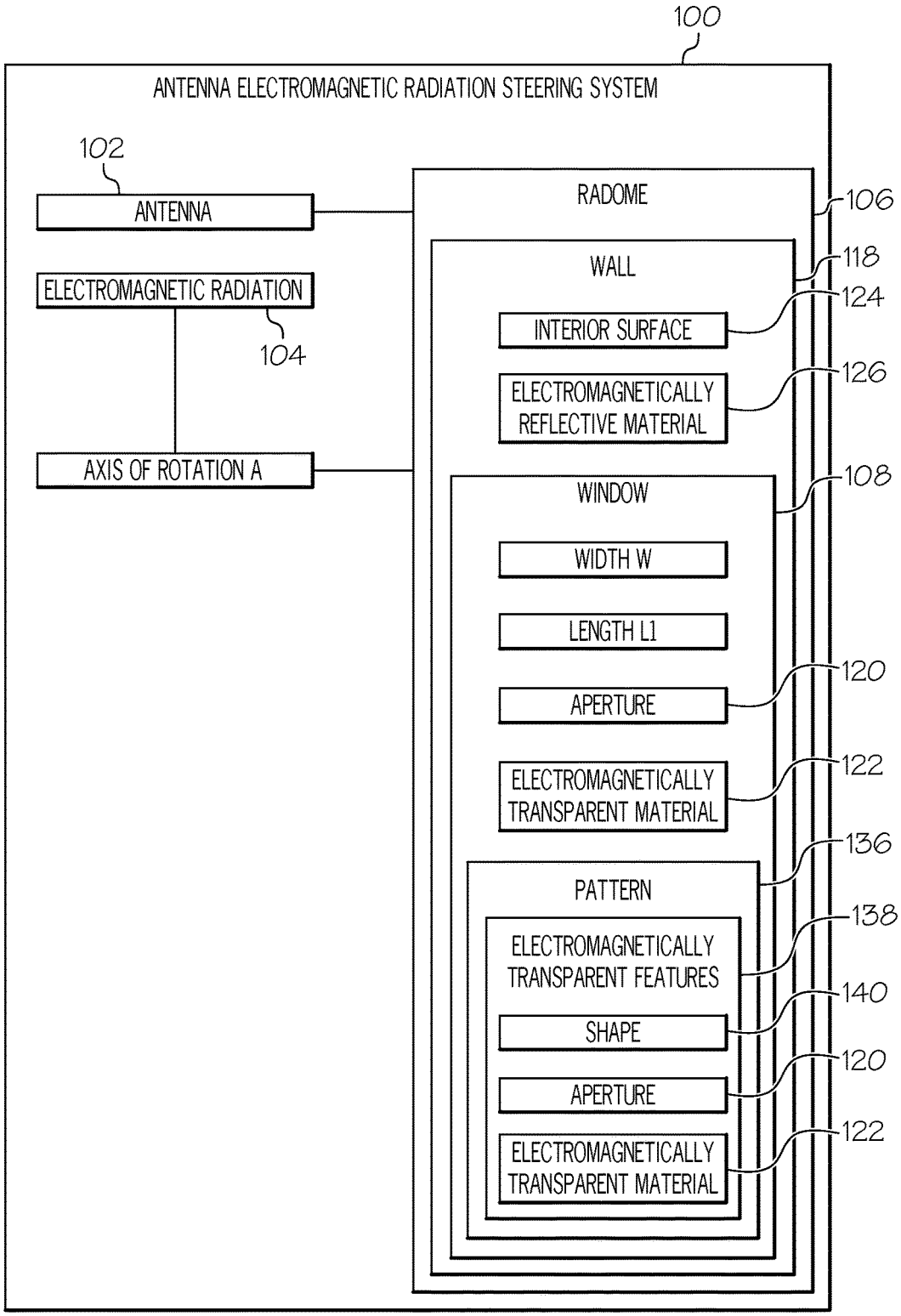
FIG. 1 is a schematic block diagram of one embodiment of the disclosed antenna electromagnetic radiation steering system.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Figure 2:
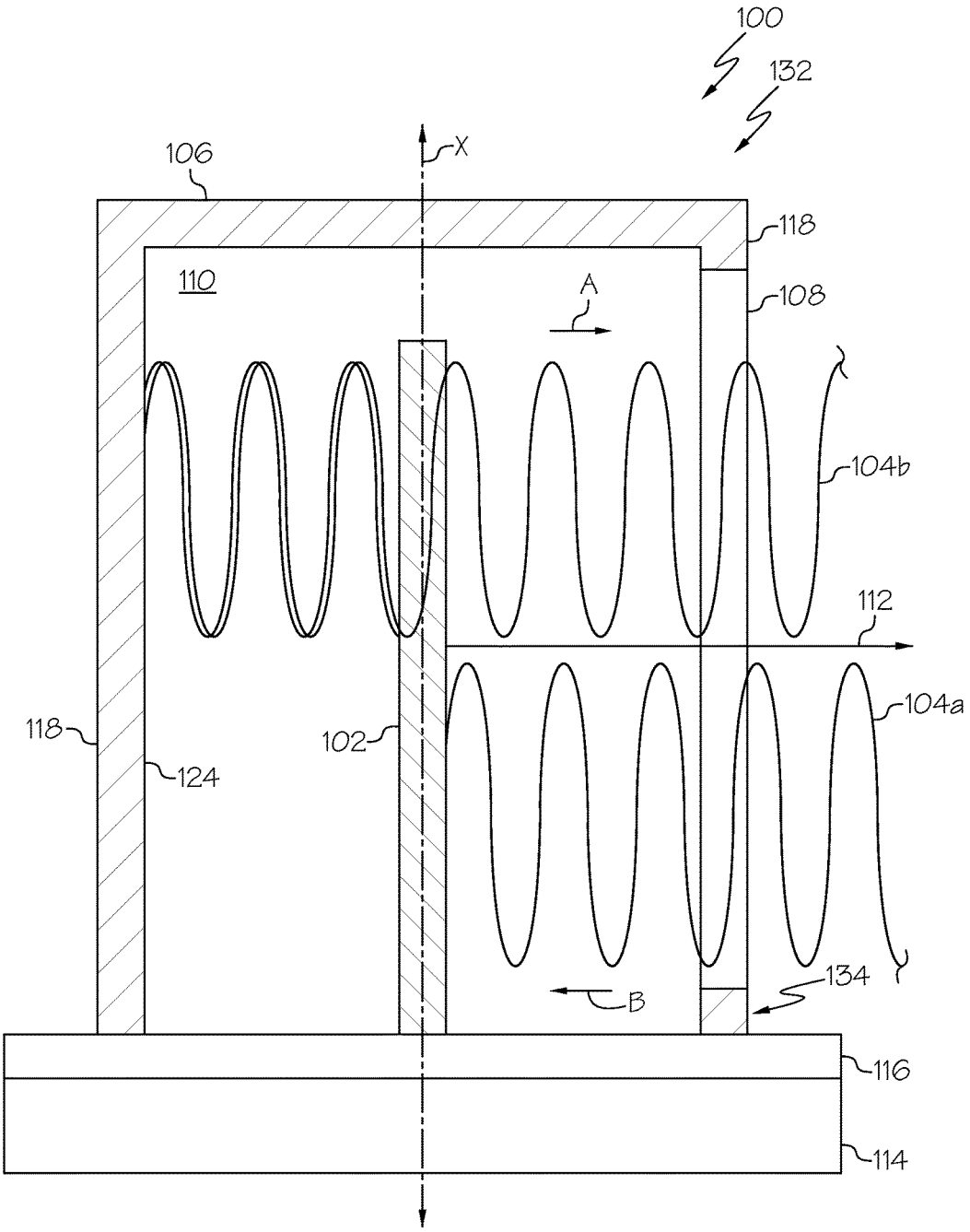
FIG. 2 is a schematic cross-sectional view of one embodiment of the disclosed antenna electromagnetic radiation steering system of FIG. 1.

Referring to FIGS. 1 and 2, one embodiment of the disclosed antenna electromagnetic radiation steering system, generally designated 100, may include an antenna 102 and a radome 106. The antenna 102 may emit electromagnetic radiation 104 (also referred to herein generally as a radio wave, radio waves, or radio wave beam). As one example, electromagnetic radiation 104 may include any portion of the electromagnetic spectrum. As another example, electromagnetic radiation 104 may include electromagnetic radiation within the portion of the electromagnetic spectrum spanning from approximately 3 Hz to approximately 3000 GHz (or 3 THz). As another example, electromagnetic radiation 104 may include electromagnetic radiation within the portion of the electromagnetic spectrum spanning from approximately 3 Hz to approximately 300 GHz. As another example, electromagnetic radiation 104 may include electromagnetic radiation within the portion of the electromagnetic spectrum spanning from approximately 3 Hz to approximately 300 MHz. As yet another example, electromagnetic radiation 104 may include electromagnetic radiation within the portion of the electromagnetic spectrum spanning from approximately 3 Hz to approximately 300 kHz.

As used herein a person of ordinary skill would appreciate that the disclosed frequencies may vary about the disclosed limits by approximately 10 percent to 15 percent. For example, approximately 3000 GHz may be between approximately 2550 GHz and 2700 GHz.

The antenna 102 may be any apparatus or system that transmits (arrow A), receives (arrow B), or both transmits and receives (arrows A and B) electromagnetic radiation 104, as best illustrated in FIG. 2. As one general, non-limiting example, the antenna 102 may be a radio antenna. As another general, non-limiting example, the antenna 102 may be a microwave antenna. As yet another general, non-limiting example, the antenna 102 may be a radar antenna. As one specific, non-limiting example, the antenna 102 may be an omnidirectional antenna. As another specific, non-limiting example, the antenna 102 may be a dipole antenna. As another specific, non-limiting example, the antenna 102 may be a half-wave dipole antenna (e.g., a coaxial antenna). As another specific, non-limiting example, the antenna 102 may be an array of dipole antennas (e.g., collinear antenna array). As yet another specific, non-limiting example, the antenna 102 may be a monopole antenna. Other types of antennas are also contemplated, without limitation.

The radome 106 may be disposed adjacent to and at least partially enclose the antenna 102. For example, and as best illustrated in FIG. 2, the radome 106 may define an enclosed, interior volume 110 and the antenna 102 may be housed within the enclosed, interior volume 110 of the radome 106. As non-limiting examples, the shape of the interior volume 110 may be a cylinder, a sphere, a semi-sphere, a cone, or a pyramid. The radome 106 may protect the antenna 102 from environmental conditions such as rain, sleet, snow, dirt, wind, lightning, etc. The radome 106 may be configured to enhance antenna gain (e.g., shaping a focused, narrow radio wave beam width), prevent emitted electromagnetic radiation 104 in unwanted directions, and steer emitted electromagnetic radiation 104 in a selected direction (e.g., forcing a direction of the shaped radio wave beam).

In one example construction, the radome 106 may be constructed of a metallic material. As one example, the radome 106 may be a solid metal radome. As another example, the radome 106 may include at least 90 percent metal. In another example construction, the radome 106 may be constructed of a dielectric material (e.g., a dielectric radome). In yet another example construction, the radome 106 may be constructed of a metallic material and a dielectric material (e.g., a metal-dielectric radome). The radome 106 may be constructed of other types of materials or combinations of materials including, but not limited to, ceramic materials (e.g., a ceramic radome).

The present disclosure recognizes that a metal radome may be particularly beneficial by overcoming mechanical and electrical limitations of conventional dielectric or ceramic radomes in high-speed, all weather applications (e.g., in aircraft applications). For example, a metallic radome may offer the potential for greater overall mechanical strength, enhanced resistance to environmental stresses (e.g., caused by rain, hail, dust, lightning, etc.) and improved static discharge performance.

The radome 106 may be movable relative to the antenna 102. In one example implementation, the radome 106 may be moved relative to the antenna 102 in a regular rotation. In another example implementation, the radome 106 may be moved relative to the antenna 102 in an irregular rotation. In another example implementation, the radome 106 may be moved relative to the antenna 102 in a regular oscillation. In another example implementation, the radome 106 may be moved relative to the antenna 102 in an irregular oscillation.

As one example, the antenna 102 may be stationary and the radome 106 may be rotatable about rotational axis X relative to the antenna 102. As one specific, non-limiting example, the radome 106 may rotate at least 45-degrees about rotational axis X relative to the antenna 102. As another specific, non-limiting example, the radome 106 may rotate at least 90-degrees about rotational axis X relative to the antenna 102. As another specific, non-limiting example, the radome 106 may rotate at least 180-degrees about rotational axis X relative to the antenna 102. As another specific, non-limiting example, the radome 106 may rotate at least 270-degrees about rotational axis X relative to the antenna 102. As yet another specific, non-limiting example, the radome 106 may rotate at least 360-degrees about rotational axis X relative to the antenna 102.

While rotational axis X is illustrated as being a substantially vertical axis in FIG. 2, rotational axis X may also be a substantially horizontal axis or another axis disposed at any non-zero angle relative to a horizontal axis or a vertical axis. For example, rotational axis X may pass through (e.g., be substantially coaxial with) the antenna 102, as best illustrated in FIG. 2.

In one example embodiment, a radome drive mechanism 116 may be operatively coupled to the radome 106 for moving (e.g., rotating about rotational axis X) the radome 106 relative to the stationary antenna 102. As one example, the radome drive mechanism 116 may include a stepper motor that divides partial rotation or full rotation of the radome 106 into a number of equal steps to control an azimuth of electromagnetic radiation 104 radiating from the radome 106. As another example, the radome drive mechanism 116 may include a gimbal to control an elevation (e.g., attitude) of electromagnetic radiation 104 radiating from the radome 106. As yet another example, the radome drive mechanism 116 may include a motor and a gimbal to control azimuth and elevation of electromagnetic radiation 104 radiating from the radome 106.

In one example embodiment, the radome 106 may include a window 108. The window 108 may be electromagnetically transparent. The window 108 may allow electromagnetic radiation 104 emitted by the antenna 102 to pass from the antenna 102 to outside of the radome 106 (e.g., through the window 108). The electromagnetic radiation 104 may be directed based on a position of the window 108 relative to the antenna 102. For example, and as best illustrated in FIG. 2, electromagnetic radiation 104 radiating from the radome 106 may be directed in and limited to a direction (directional arrow 112) that passes through the window 108. The position of the window 108 relative to the antenna 102 may be based on the rotated position of the radome 106 relative to the antenna 102.

The window 108 may be formed (e.g., fabricated) into a wall 118 of the radome 106. In one example embodiment, the window 108 may be an aperture 120 (e.g., an absence of material) formed in the wall 118 of the radome 106. In another example embodiment, the window 108 may be formed from an electromagnetically transparent material 122 (e.g., a dielectric material or an electromagnetically transparent screen) formed in the wall 118 of the radome 106.

In one example implementation, the window 108 may be electromagnetically transparent to electromagnetic radiation 104 having any operating wavelength. For example, an open-air window 108 (e.g., the aperture 120) may allow electromagnetic radiation 104 having any wavelength to pass through the window 108. In another example implementation, the window 108 may be electromagnetically transparent to electromagnetic radiation 104 having a predetermined wavelength. For example, the electromagnetically transparent material 122 forming the window 108 may be selected to allow only electromagnetic radiation 104 having a predetermined wavelength (e.g., a desired operating band) to pass through the window 108 and prevent electromagnetic radiation 104 not having the predetermined wavelength (e.g., a non-operating band) from passing through the window 108.

The wall 118 of the radome 106 may be electromagnetically reflective. For example, at least an interior surface 124 of the wall 118 of the radome 106 may be electromagnetically reflective. As one example, the wall 118 of the radome 106 may be formed from an electromagnetically reflective material 126. As another example, the interior surface 124 of the wall 118 of the radome 106 may be formed from, covered by, or coated with the electromagnetically reflective material 126.

In one example implementation, the wall 118 (or at least the inner surface 124 of the wall 118) may be electromagnetically reflective to electromagnetic radiation 104 having any operating wavelength. For example, the inner surface 124 of the wall may reflect electromagnetic radiation 104 having any wavelength. In another example implementation, the wall 118 (or at least the inner surface 124 of the wall 118) may be electromagnetically reflective to electromagnetic radiation 104 having a predetermined wavelength. For example, the electromagnetically reflective material 126 may be selected to reflect only electromagnetic radiation 104 having the predetermined wavelength (e.g., the desired operating band) indented to pass through the window 108 and absorb electromagnetic radiation 104 not having the predetermined wavelength (e.g., the non-operating band).

Figure 3:
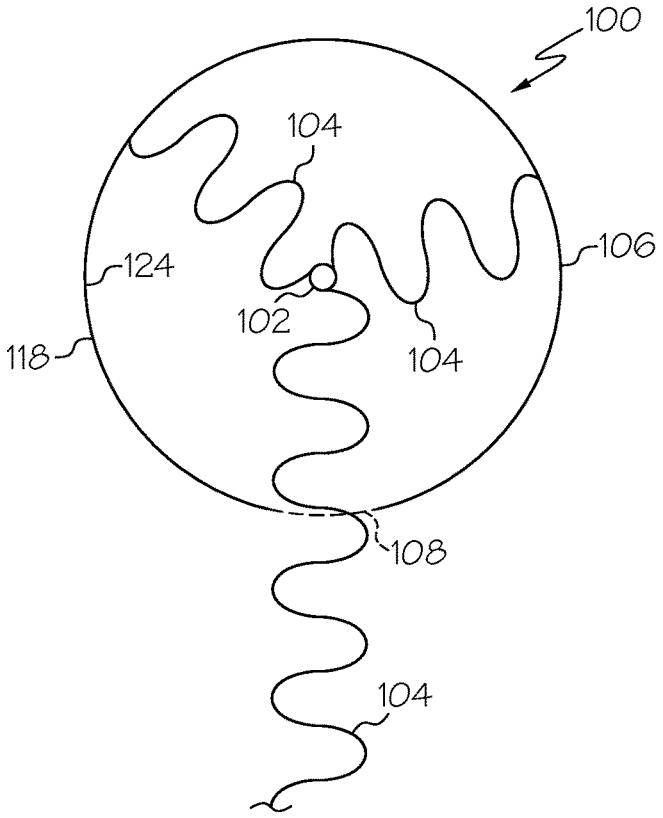
FIG. 3 is a schematic plan view of the antenna electromagnetic radiation steering system of FIG. 2 at a first position.
Figure 4:
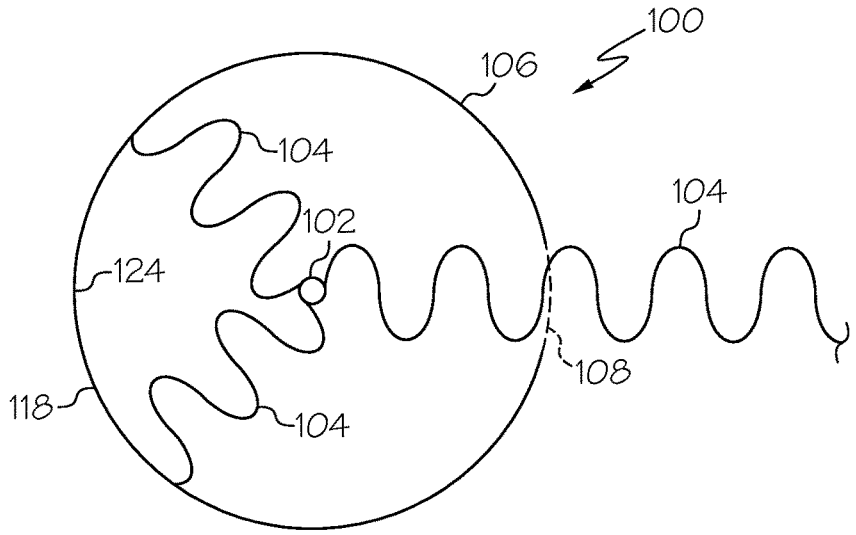
FIG. 4 is a schematic plan view of the antenna electromagnetic radiation steering system of FIG. 2 at a second position.

Referring to FIGS. 2-4, creating the window 108 in the radome 106 (e.g., a metallic radome) may affect the directionality of electromagnetic radiation 104 emitted by the antenna 102 enclosed within the radome 106 by limiting electromagnetic radiation 104 radiating from the radome 106 to the portion of which that passes through the window 108. Thus, movement of the radome 106 (e.g., rotation of the radome 106) may change the position of the window 108 relative to the antenna 102 (e.g., move the window 108 relative to the antenna 102), which may result in directing electromagnetic radiation 104 emitted by the antenna 102 in a predetermined direction based on the position of the window 108 (e.g., a radio wave beam steering capability), as best illustrated in FIGS. 3 and 4.

Figure 5:
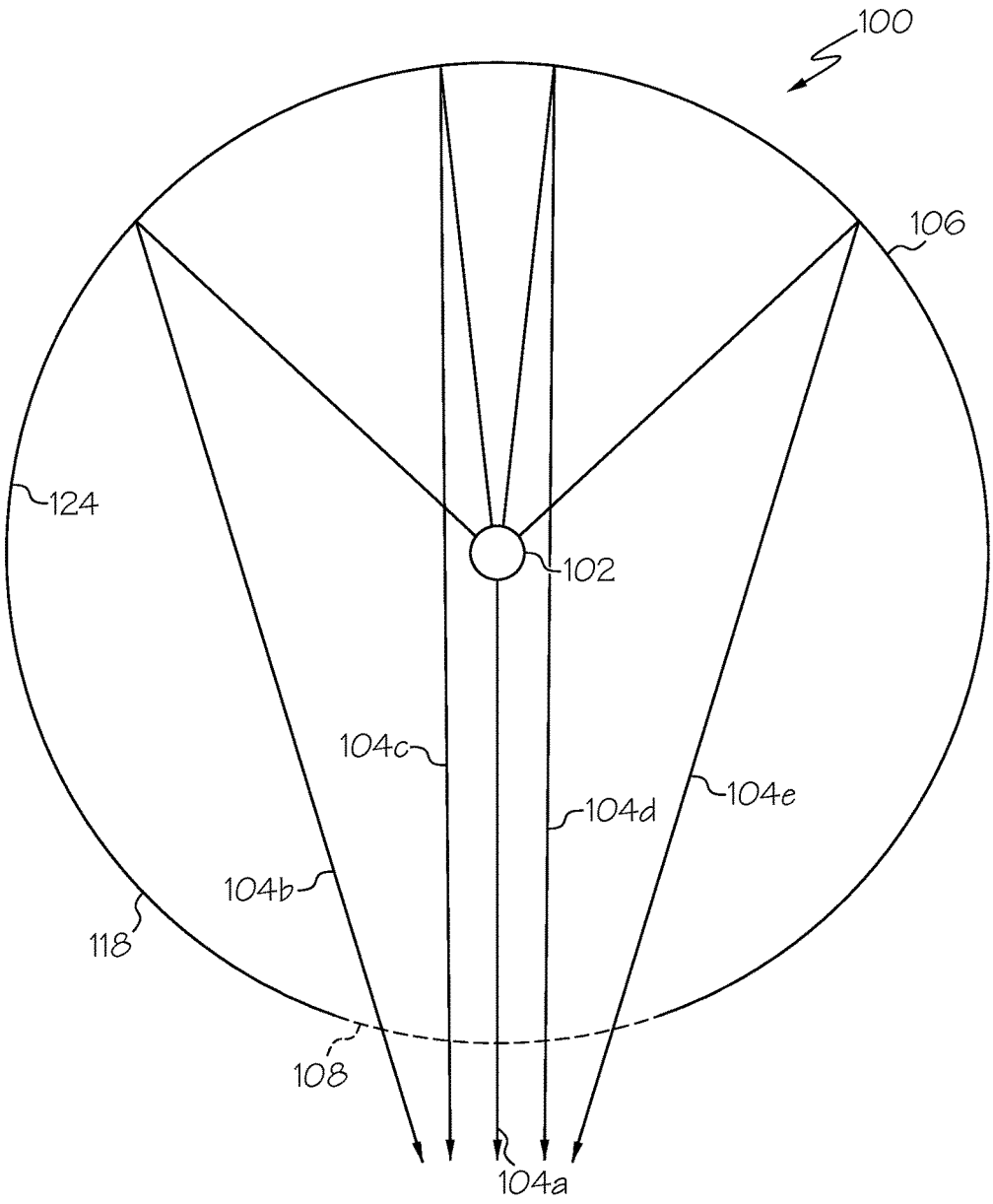
FIG. 5 is another schematic plan view of the antenna electromagnetic radiation steering system of FIG. 2.

Referring to FIGS. 2 and 5, the electromagnetically reflective interior surface 124 of the radome 106 (e.g., of the wall 118 of the radome 106) may reflect portions of omnidirectional electromagnetic radiation 104 that would have radiated in a direction of the wall 118 back in the direction of the window 108. For example, portion of electromagnet radiation 104*a* may radiate from the antenna 102 in a direction substantially aligned with and passing through the position of the window 108. Portions of electromagnetic radiation 104*b*, 104*c*, 104*d*, 104*e*, etc. may radiate from the antenna 102 in other directions and be reflected by the radome 106 back in a direction of and pass through the position of the window 108. Thus, such electromagnetic reflection may increase electromagnetic radiation 104 passing through the window 108 and/or focus electromagnetic radiation 104 passing through the window 108 (e.g., packing electromagnetic radiation 104 into one direction), which may result in an increase in gain (e.g., a higher antenna gain may be achieved by concentrating the radio wave).

Rotation of the radome 106 about axis of rotation X relative to the antenna 102 may rotate the window 108 about axis of rotation X relative to the antenna 102, thus essentially rotating the direction of electromagnetic radiation 104 about axis of rotation X.

As best illustrated in FIG. 2, the radome 106 and associated antenna 102 may be mounted on or secured to a support structure 114. As one example, the support structure 114 may be a vehicle, which may be a terrestrial vehicle (e.g., an aircraft, a boat/ship or a ground vehicle) or a space vehicle (e.g., a spacecraft or a satellite). As another example, the support structure 114 may be the ground, a building or other structure, or the like.

As best illustrated in FIGS. 2-5, in one general, non-limiting example embodiment, the antenna 102 may be an omnidirectional, vertically oriented dipole antenna (e.g., electromagnetic radiation 104 radiates from the antenna 102 in all directions in plane perpendicular to the antenna 102).

Referring to FIGS. 6-13, the radome 106 may include various sizes and geometric shapes. The size and/or shape of the radome 106 may be dictated by the size, shape, and/or type of antenna 102. Generally, the size and/or shape of the radome 106 may be sufficient to fully enclose the antenna 102.

Figure 6:
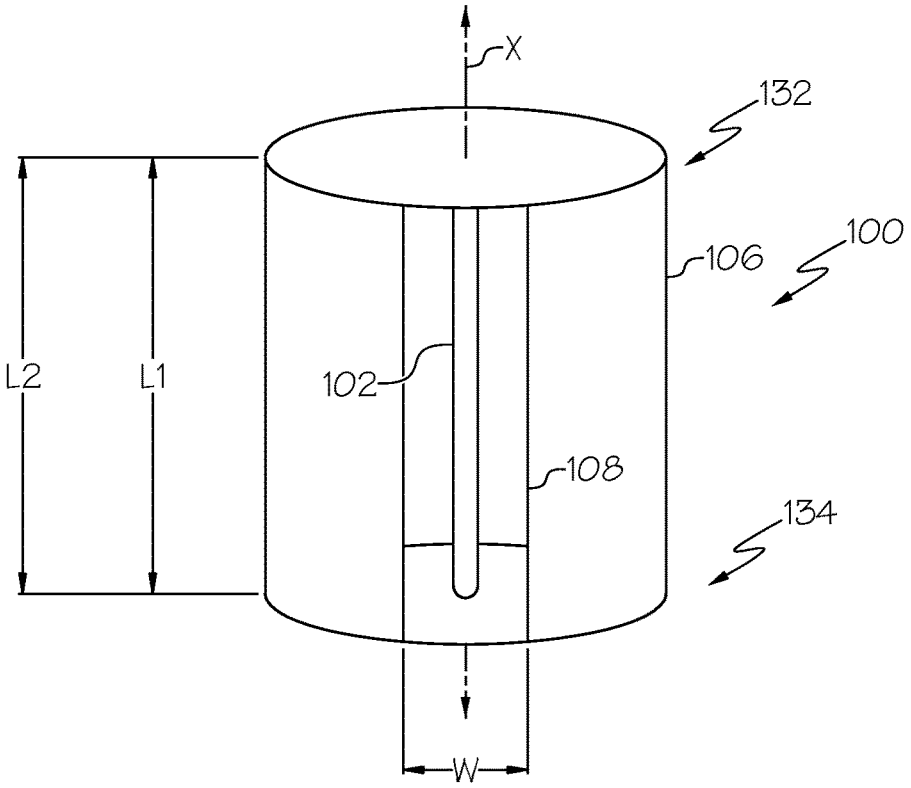
FIG. 6 is a schematic perspective view of another embodiment of the antenna electromagnetic radiation steering system of FIG. 1.
Figure 7:
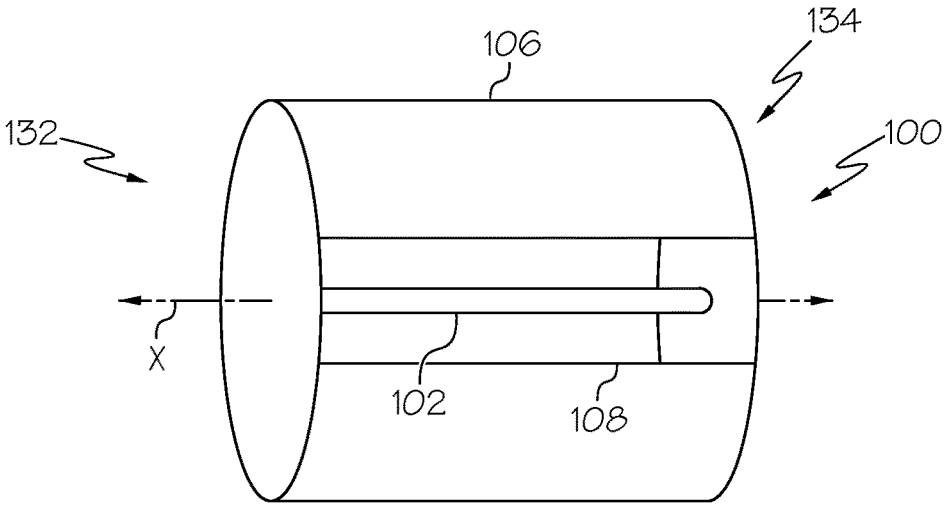
FIG. 7 is a schematic perspective view of another embodiment of the antenna electromagnetic radiation steering system of FIG. 1.

In one non-limiting example, and as illustrated in FIGS. 6 and 7, the radome 106 may include a cylindrical shape. Axis of rotation X may extend centrally through the cylindrical-shaped radome 106 and be coaxial with the antenna 102 such that the radome 106 and, thus, the window 108, may rotate about axis of rotation X relative to the antenna 102. As one example, and as illustrated in FIG. 6, axis of rotation X may be a substantially vertical axis such that rotation of the radome 106 may position the window 108 to directionally control (e.g., steer) an azimuth of electromagnetic radiation 104 having enhanced gain. As another example, and as illustrated in FIG. 7, axis of rotation X may be a substantially horizontal axis such that rotation of the radome 106 may position the window 108 to directionally control (e.g., steer) an elevation (e.g., attitude) of electromagnetic radiation 104 having enhanced gain.

Figure 8:
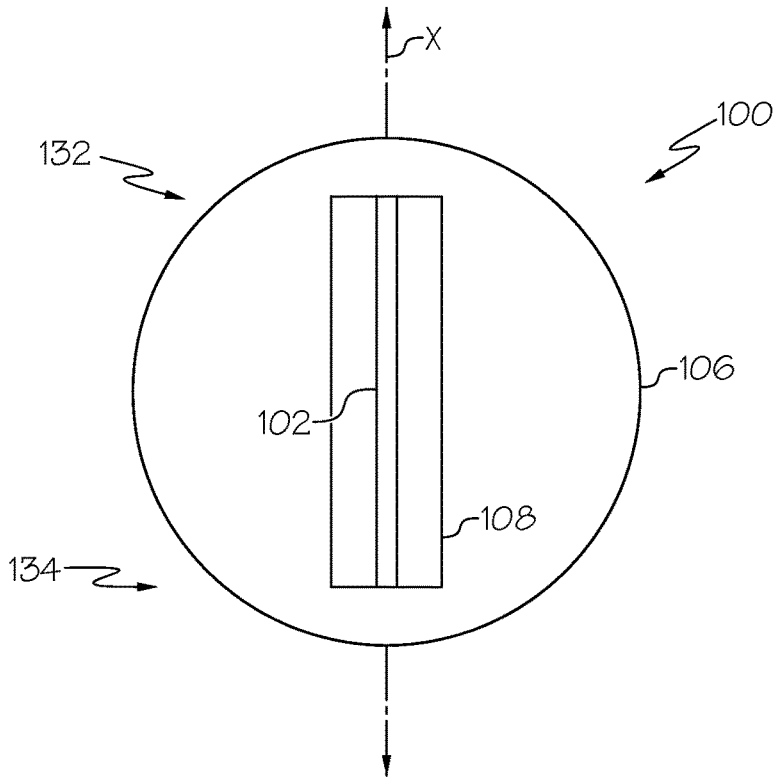
FIG. 8 is a schematic perspective view of another embodiment of the antenna electromagnetic radiation steering system of FIG. 1.
Figure 9:
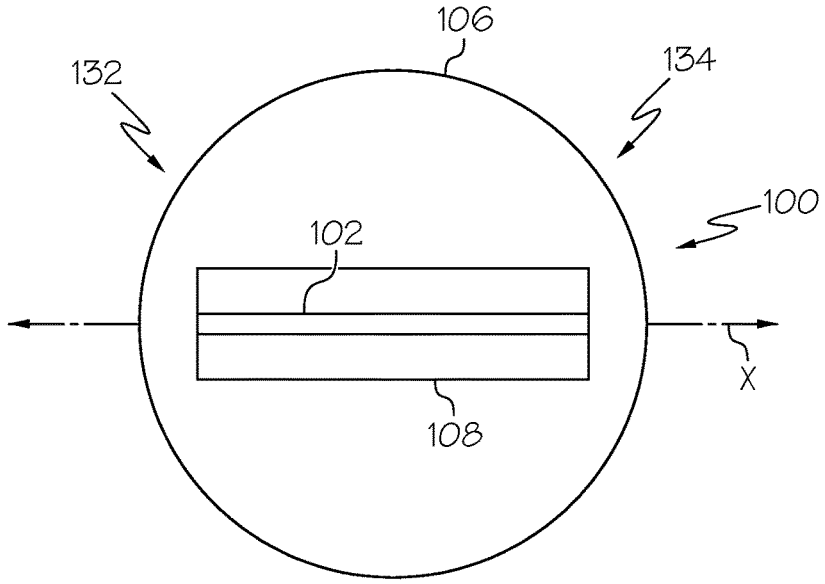
FIG. 9 is a schematic perspective view of another embodiment of the antenna electromagnetic radiation steering system of FIG. 1.

In another non-limiting example, and as illustrated in FIGS. 8 and 9, the radome 106 may include a spherical shape. Axis of rotation X may extend centrally through the spherical-shaped radome 106 and be coaxial with the antenna 102 such that the radome 106 and, thus, the window 108, may rotate about axis of rotation X relative to the antenna 102. As one example, and as illustrated in FIG. 8, axis of rotation X may be a substantially vertical axis such that rotation of the radome 106 may position the window 108 to directionally control (e.g., steer) an azimuth of electromagnetic radiation 104 having enhanced gain. As another example, and as illustrated in FIG. 9, axis of rotation X may be a substantially horizontal axis such that rotation of the radome 106 may position the window 108 to directionally control (e.g., steer) an elevation (e.g., attitude) of electromagnetic radiation 104 having enhanced gain.

Figure 10:
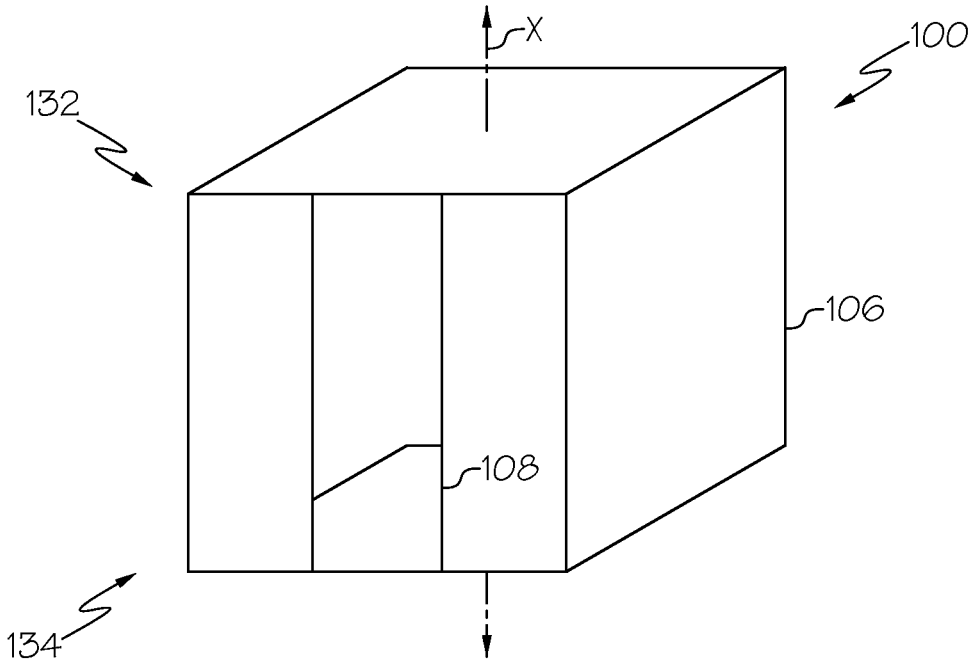
FIG. 10 is a schematic perspective view of another embodiment of the antenna electromagnetic radiation steering system of FIG. 1.

In another non-limiting example, and as illustrated in FIG. 10, the radome 106 may include a cuboidal shape (e.g., a square cuboid or rectangular cuboid). Axis of rotation X may extend centrally through the cuboidal-shaped radome 106 and be coaxial with the antenna 102 (not visible in FIG. 10) such that the radome 106 and, thus, the window 108, may rotate about axis of rotation X relative to the antenna 102. As one example, and as illustrated in FIG. 10, axis of rotation X may be a substantially vertical axis such that rotation of the radome 106 may position the window 108 to directionally control (e.g., steer) an azimuth of electromagnetic radiation 104 having enhanced gain. As another example (not shown) axis of rotation X may be a substantially horizontal axis such that rotation of the radome 106 may position the window 108 to directionally control (e.g., steer) an elevation (e.g., attitude) of electromagnetic radiation 104 having enhanced gain.

Figure 11:
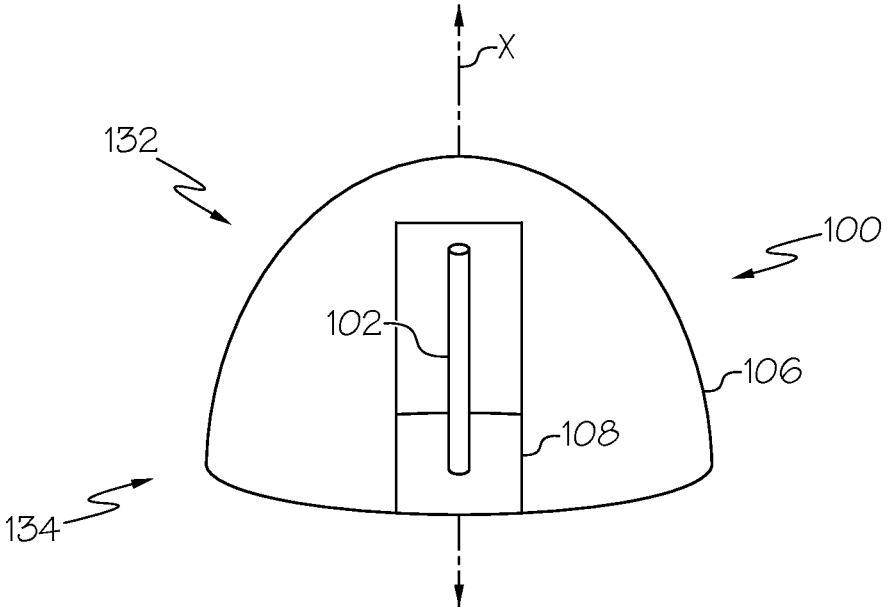
FIG. 11 is a schematic perspective view of another embodiment of the antenna electromagnetic radiation steering system of FIG. 1.

In another non-limiting example, and as illustrated in FIG. 11, the radome 106 may include a semi-spherical shape (e.g., hemispherical). Axis of rotation X may extend centrally through the semi-spherical-shaped radome 106 and be coaxial with the antenna 102 such that the radome 106 and, thus, the window 108, may rotate about axis of rotation X relative to the antenna 102. As one example, axis of rotation X may be a substantially vertical axis such that rotation of the radome 106 may position the window 108 to directionally control (e.g., steer) an azimuth of electromagnetic radiation 104 having enhanced gain.

Figure 12:
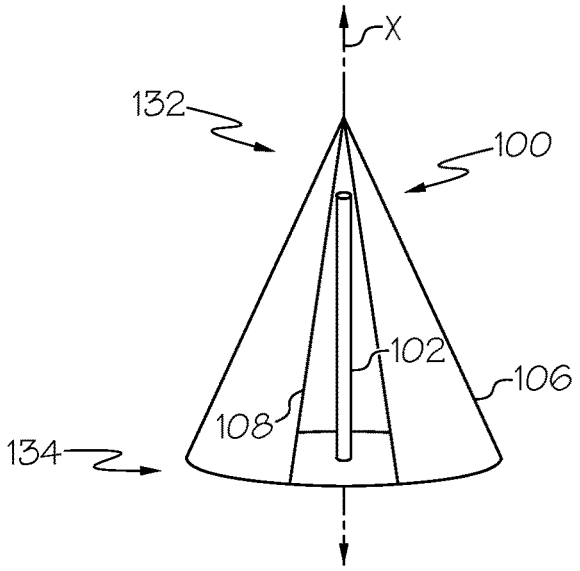
FIG. 12 is a schematic perspective view of another embodiment of the antenna electromagnetic radiation steering system of FIG. 1.

In another non-limiting example, and as illustrated in FIG. 12, the radome 106 may include a conical shape. Axis of rotation X may extend centrally through the conical-shaped radome 106 and be coaxial with the antenna 102 such that the radome 106 and, thus, the window 108, may rotate about axis of rotation X relative to the antenna 102. As one example, axis of rotation X may be a substantially vertical axis such that rotation of the radome 106 may position the window 108 to directionally control (e.g., steer) an azimuth of electromagnetic radiation 104 having enhanced gain.

Figure 13:
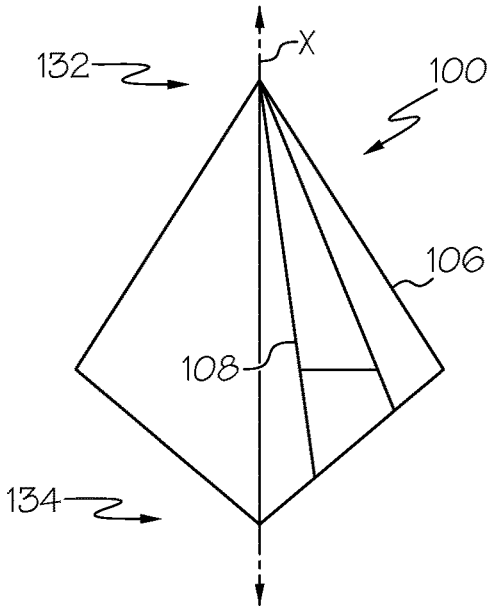
FIG. 13 is a schematic perspective view of another embodiment of the antenna electromagnetic radiation steering system of FIG. 1.
Figure 14:
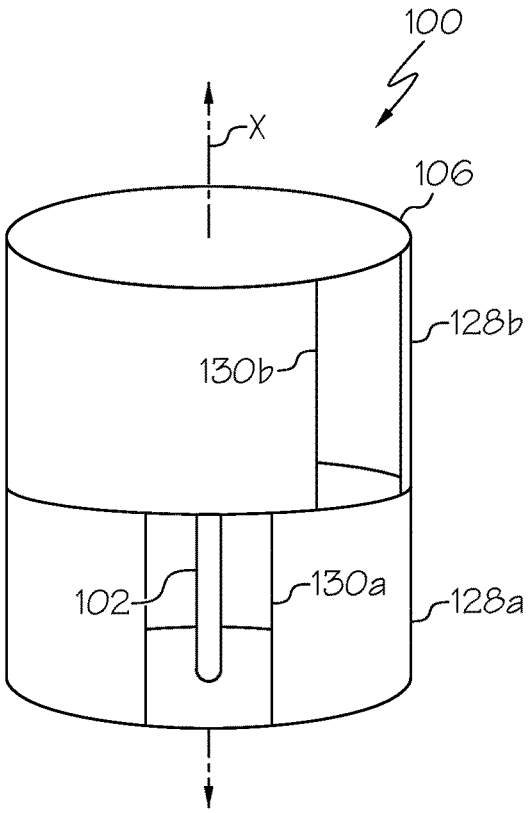
FIG. 14 is a schematic perspective view of another embodiment of the antenna electromagnetic radiation steering system of FIG. 1.

In yet another non-limiting example, and as illustrated in FIG. 13, the radome 106 may include a pyramidal shape. Axis of rotation X may extend centrally through the pyramidal-shaped radome 106 and be coaxial with the antenna

102 (not visible in FIG. 12) such that the radome 106 and, thus, the window 108, may rotate about axis of rotation X relative to the antenna 102. As one example, axis of rotation X may be a substantially vertical axis such that rotation of the radome 106 may position the window 108 to directionally control (e.g., steer) an azimuth of electromagnetic radiation 104 having enhanced gain.

Referring generally to FIGS. 6-13, and particularly to FIG. 6, the window 108 may be sized according to a predetermined (e.g., desired) operational frequency of electromagnetic radiation 104 emitted by the antenna 102 enclosed within the radome 106. The window 108 may include a width W and a length L1.

In one example implementation, the window 108 may extend from proximate (e.g., at or near) a first end 132 of the radome 106 to proximate a second end 134 of the radome 106 (e.g., from top-to-bottom or from side-to-side). In one example construction, and as best illustrated in FIG. 6, the length L1 of the window 108 may be substantially equal to a length L2 of the radome 106.

The width W of the window 108 may be dictated by (e.g., proportional to) the wavelength of electromagnetic radiation 104 emitted by the antenna 102 at a predetermined operating frequency. As one example, a ratio of the width W of the window 108 to the wavelength (or frequency) of electromagnetic radiation 104 (e.g., the operational wavelength or frequency of electromagnetic radiation 104) may be based on a predetermined ratio. In one example implementation, the width W of the window 108 may be approximately between ⅛ the wavelength of electromagnetic radiation 104 and ½ the wavelength of electromagnetic radiation 104 at the predetermined operating frequency. In another example implementation, the width W of the window 108 may be approximately ⅛ the wavelength of electromagnetic radiation 104 at the predetermined operating frequency. In another example implementation, the width W of the window 108 may be approximately ⅙ the wavelength of electromagnetic radiation 104 at the predetermined operating frequency. In another example implementation, the width W of the window 108 may be approximately ¼ the wavelength of electromagnetic radiation 104 at the predetermined operating frequency. In yet another example implementation, the width W of the window 108 may be approximately ½ the wavelength of electromagnetic radiation 104 at the predetermined operating frequency.

Those skilled in the art will recognize that the radome shapes described above and illustrated in FIGS. 6-13 and the window sizes described above are only examples of various geometric shapes of the radome 106 and widths W of the window 108. Other shapes and sizes are also contemplated. The particular size and/or shape of the radome 106 and/or the size of the window 108 may be dictated by size and/or type of antenna 102 used and/or the operational frequency desired for electromagnetic radiation 104.

Those skilled in the art will also recognize that the shape of the radome 106, the size of the window 108, and/or the type of antenna 102 used inside the radome 106 may be important considerations in order to achieve optimal focusing of electromagnetic radiation 104 (e.g., optimal radio wave beam focusing) through the window 108. As one example, too small of a window 108 (e.g., a window 108 having an ineffectively small width W) may result in the resistance of electromagnetic radiation 104 emitted by the antenna 102 being reduced to near zero. As another example, too large of a window 108 (e.g., a window 108 having an ineffectively large width W) may decrease the gain of electromagnetic radiation 104 (e.g., increase the width of the radio wave beam).

As one example, the size and/or shape of the radome 106 and/or the size of the window 108 may be determined utilizing computational models and/or parametric analysis based on operational wavelengths and/or frequencies of electromagnetic radiation 104. The entire structure of the disclosed antenna electromagnetic radiation steering system 100 (e.g., the radome 106, the window 108, and the antenna 102) may be scaled up or down by any factor to shift the operating frequency of electromagnetic radiation 104.

In any of the examples illustrated in FIGS. 6-13, the radome 106 may include a number of corner reflectors (not shown) positioned within the interior volume 110 of the radome 106 and positioned proximate the antenna 102 to further direct and/or focus (e.g., shape) electromagnetic radiation 104 (e.g., radio wave beam) in a direction passing through the window 108.

Referring to FIGS. 14-17, in one example embodiment, the radome 106 may include independently movable sections 128 (e.g., two or more independent movable sections identified individually as section 128*a* and 128*b* in FIGS. 14-17) and windows 130 (e.g., two or more windows identified individually as widow 130*a* and 130*b* in FIGS. 14-17). As one example, a window 130*a*, 130*b* may be formed in each respective section 128*a*, 128*b* of the radome 106 (e.g., may be formed in the wall 118 of the radome 106 defining the section 128*a*, 128*b*).

The interior surface 124 of the wall 118 defining the sections 128 of the radome 106 may be electromagnetically reflective, as described above and illustrated in FIGS. 2-5. For example, the interior surface 124 of the sections 128 may be formed from or covered by the electromagnetically reflective material 126. The windows 130 may be substantially the same as the window 108 described above and illustrated in FIGS. 2-5. For example, the windows 130 may be electromagnetically transparent. As one example, each window 130*a*, 130*b* may be an aperture 120 (e.g., an absence of material formed in the wall 118 of the radome 106). As another example, each window 130*a*, 130*b* may be the electromagnetically transparent material 122 formed in the wall 118 of the radome 106. As yet another example, window 120 may be an aperture 120 and window 130*b* may be the electromagnetically transparent material 122.

Figure 15:
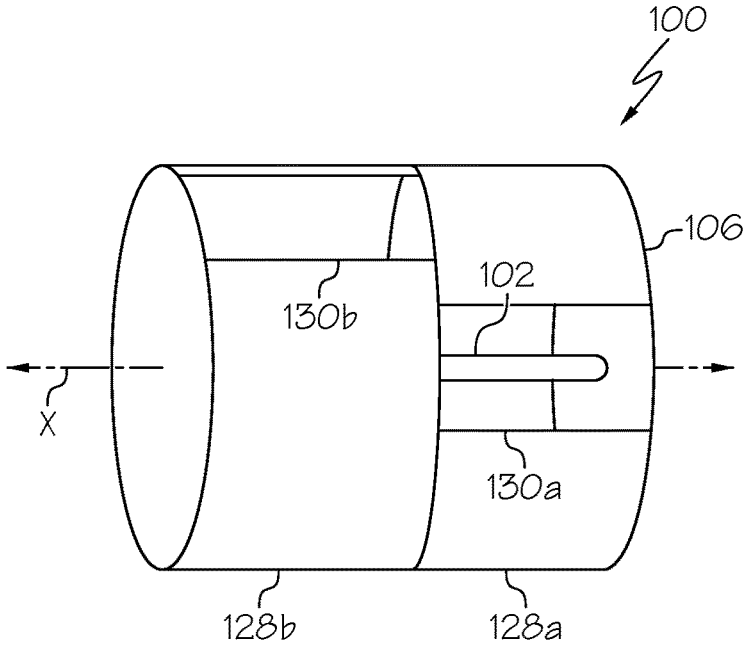
FIG. 15 is a schematic perspective view of another embodiment of the antenna electromagnetic radiation steering system of FIG. 1.
Figure 16:
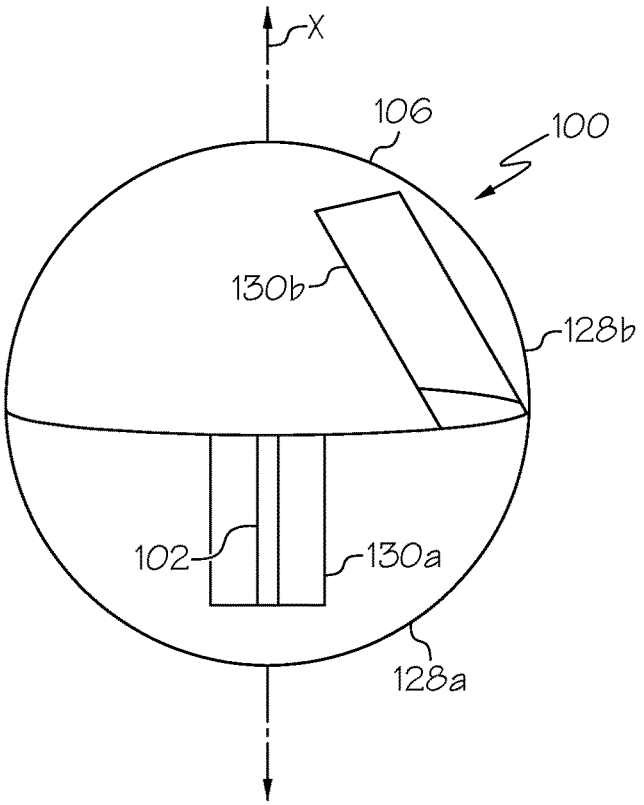
FIG. 16 is a schematic perspective view of another embodiment of the antenna electromagnetic radiation steering system of FIG. 1.
Figure 17:
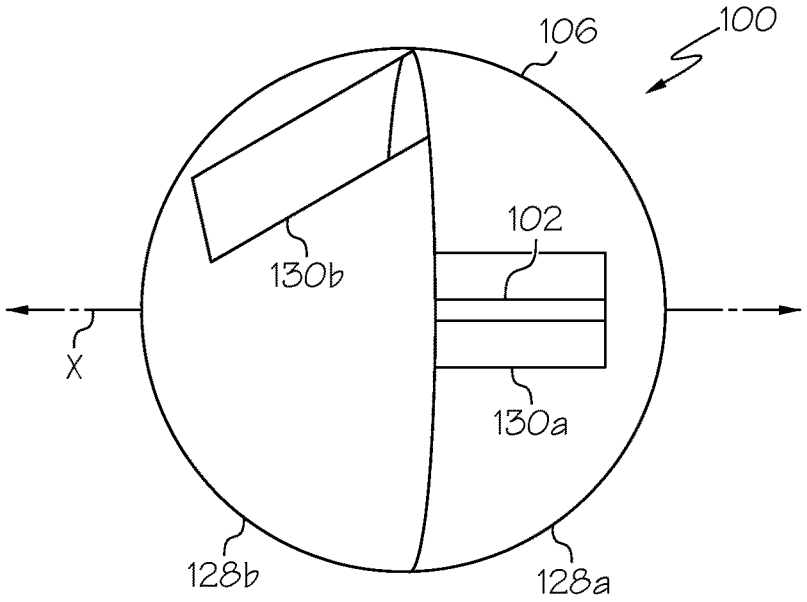
FIG. 17 is a schematic perspective view of another embodiment of the antenna electromagnetic radiation steering system of FIG. 1.

Each of the sections 128 (e.g., section 128*a*, 128*b*) may be independently rotatable about rotational axis X relative to the antenna 102 enclosed within the radome 106. As one example, and as illustrated in FIGS. 15 and 17, section 128*a* and section 128*b* may independently rotate about a substantially vertical axis of rotation X such that each section 128*a*, 128*b* may position respective window 130*a*, 130*b* to directionally control (e.g., steer) electromagnetic radiation 104 having enhanced gain at different azimuths simultaneously (e.g., create multiple radio wave beams). As another example, and as illustrated in FIGS. 16 and 18, section 128*a* and section 128*b* may independently rotate about a substantially horizontal axis of rotation X such that each section 128*a*, 128*b* may position respective window 130*a*, 130*b* to directionally control (e.g., steer) electromagnetic radiation 104 having enhanced gain at different elevations (e.g., attitudes) simultaneously (e.g., create multiple radio wave beams).

While only cylindrical-shaped radomes and spherical shaped radomes are illustrated by example in FIGS. 14-17, those skilled in the art will recognize that a radome 106 having any geometric shape may include sections 128 and windows 130.

Those skilled in the art will recognize that the more windows 130 that are formed in the radome 106 (e.g., the more independently rotatable sections 128) may achieve electromagnetic radiation 104 passing through each window 130*a*, 130*b* having a lower enhanced gain (e.g., a lower gain per radio wave beam) than when the windows 130 are coaxially aligned or when the radome 106 includes a larger, single window 108.

Figure 18:
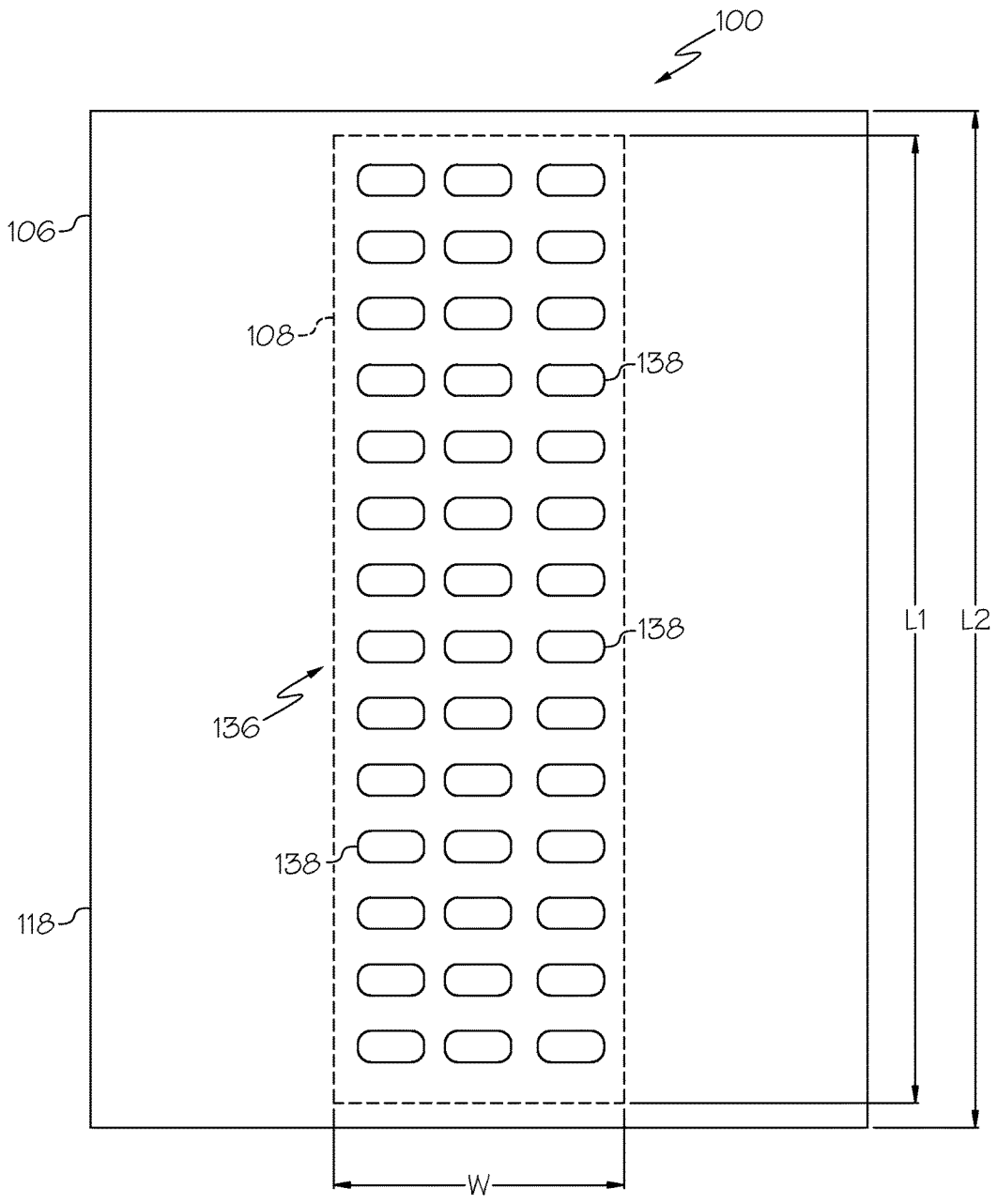
FIG. 18 is a schematic elevation view of another embodiment of the antenna electromagnetic radiation steering system of FIG. 1.

Referring to FIG. 18, in one example embodiment, the window 108 may be defined by an electromagnetically transparent pattern 136 formed in radome 106 (e.g., in the wall 118 of the radome 106). The pattern 136 may include a plurality of electromagnetically transparent features 138 (e.g., an array of features 138). The features 138 may extend the length L1 and the width W of the window 108. In one example construction, the features 138 defining the pattern 136 may be equally spaced apart from one another. In another example construction, the features 138 defining the pattern 136 may not be equally spaced apart from one another. In another example construction, the features 138 defining the pattern 136 may be coaxially aligned with one another along at least one of a horizontal axis and/or a vertical axis. In yet another example construction, the features 138 defining the pattern 136 may be offset (e.g., staggered) along at least one of a horizontal axis and/or a vertical axis.

Each feature 138 may be formed (e.g., fabricated) into the radome 106 (e.g., into the wall 118 of the radome 106). In one example embodiment, the each feature 138 may be an aperture 120 (e.g., an absence of material) in the radome 106 (e.g., in the wall 118 of the radome 106). In another example embodiment, each feature 138 may be formed from an electromagnetically transparent material 122 (e.g., a dielectric material or an electromagnetically transparent screen) formed in the radome 106 (e.g., in the wall 118 of the radome 106).

In one example implementation, the pattern 136 of features 138 may be electromagnetically transparent to electromagnetic radiation 104 having any operating wavelength. For example, open-air window features 138 (e.g., each feature forms an aperture 120) may allow electromagnetic radiation 104 having any wavelength to pass through the features 138 (e.g., the pattern 136 of features 138 defining the electromagnetically transparent window 108). In another example implementation, the features 138 may be electromagnetically transparent to electromagnetic radiation 104 having a predetermined wavelength. For example, the electromagnetically transparent material 122 forming the feature 138 may be selected to allow only electromagnetic radiation 104 having a predetermined wavelength (e.g., a desired operating band) to pass through the feature 138 (e.g., the pattern 136 of features 138 defining the electromagnetically transparent window 108) and prevent electromagnetic radiation 104 not having the predetermined wavelength (e.g., a non-operating band) from passing through the feature 138.

Figure 19A:
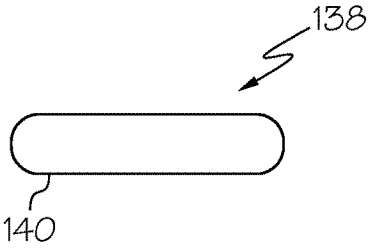
FIGS. 19A-19K are schematic illustrations of two-dimensional shapes of the electromagnetically transparent features of FIG. 1.
Figure 19B:
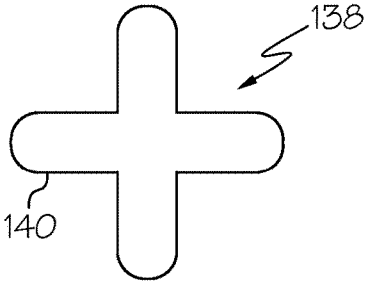
Figure 19C:
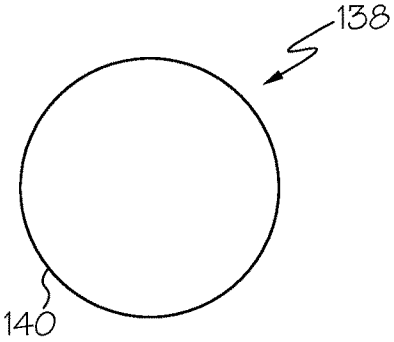
Figure 19D:
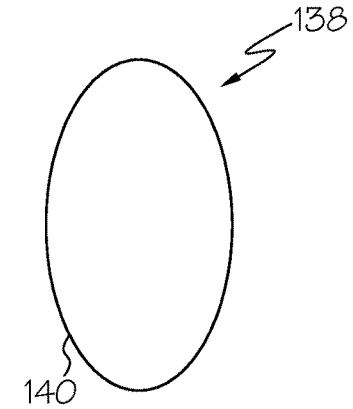
Figure 19E:
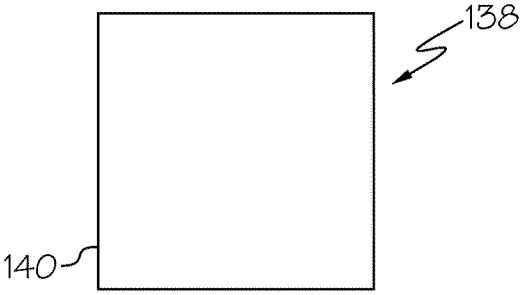
Figure 19F:
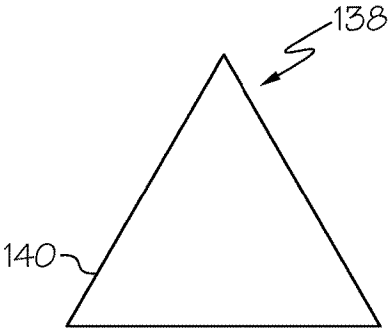
Figure 19I:
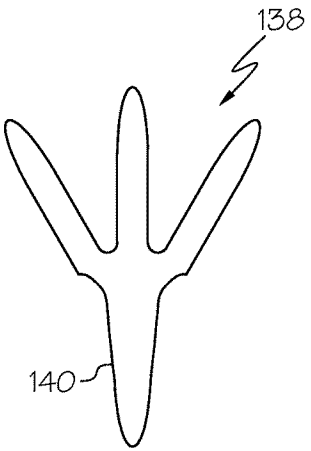
Figure 19H:
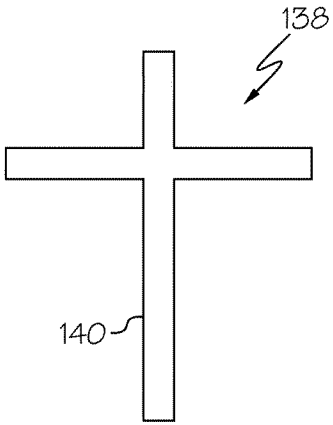
Figure 19G:
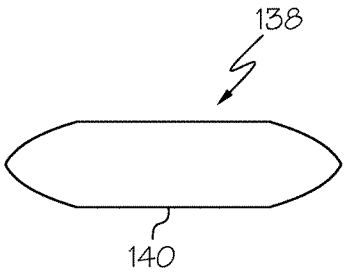
Figure 19K:
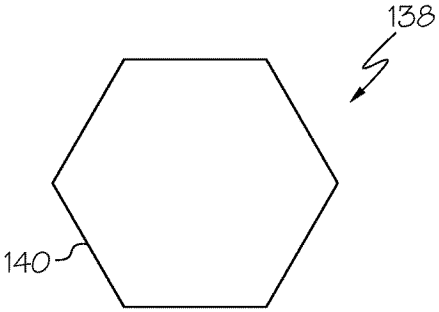
Figure 19J:
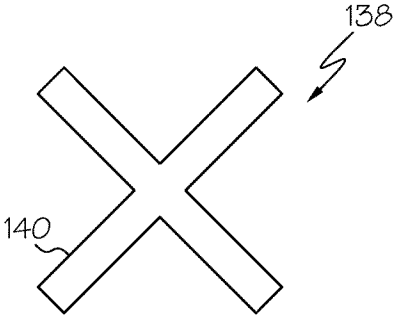

Referring to FIGS. 19A-19K, each feature 138 may include a two-dimensional shape 140 (e.g., a two-dimensional geometry). In one specific, non-limiting example construction, the shape 140 of the features 138 may include a slot shape, as illustrated in FIG. 19A. In another specific, non-limiting example construction, the shape 140 of the features 138 may include a plus shape, as illustrated in FIG. 19B. In another specific, non-limiting example construction, the shape 140 of the features 138 may include a circular shape, as illustrated in FIG. 19C. In another specific, non-limiting example construction, the shape 140 of the features 138 may include an ovular shape as illustrated in FIG. 19D. In another specific, non-limiting example construction, the shape 140 of the features 138 may include a rectangular shape (e.g., a square or rectangle), as illustrated in FIG. 19E. In another specific, non-limiting example construction, the shape 140 of the features 138 may include a triangular shape, as illustrated in FIG. 19F. In another specific, non-limiting example construction, the shape 140 of the features 138 may include an ogive shape (e.g., having at least one roundly tapered end), as illustrated in FIG. 19G. In another specific, non-limiting example construction, the shape 140 of the features 138 may include a cross shape, as illustrated in FIG. 19H. In another specific, non-limiting example construction, the shape 140 of the features 138 may include a chicken-foot shape, as illustrated in FIG. 19I. In another specific, non-limiting example construction, the shape 140 of the features 138 may include an X shape, as illustrated in FIG. 19J. In another specific, non-limiting example construction, the shape 140 of the features 138 may include any other polygonal shape (e.g., a hexagon), as illustrated in FIG. 19K. In this manner, the shape 140 (e.g., the two-dimensional geometry) may be selected from one of a slot, a plus, a circle, an oval, a rectangle, a triangle, an ogive, a cross, a chicken-foot, an X, or a polygon. Other shapes 140 of the features 138 defining the pattern are also contemplated.

In another example embodiment, the window 108 formed from a pattern 136 of electromagnetically transparent features 138 may employ the Munk frequency selective two-dimensional geometries depending on the desired frequency selectivity of the radome 106.

In another example embodiment, the system 100 may be configured to receive electromagnetic radiation 104 having a (e.g., first) frequency F1 and transmit electromagnetic radiation 104 having a (e.g., second) frequency F2. Thus, the system 100 may be a transponder system. In such an example embodiment, the antenna 102 may receive electromagnetic radiation 104 having the frequency F1 in any direction but transmit electromagnetic radiation 104 having the frequency F2 in a selected direction dictated by the position of the window 108 relative to the antenna 102.

In one example construction, the antenna 102 may be a multi-band antenna designed to operate on frequency F1 and frequency F2. As one specific, non-limiting example, the antenna 102 may be a multi-band tree-ring antenna. In one example implementation, the antenna 102 may periodically transmit electromagnetic radiation 104 having the frequency F2 and continuously receive electromagnetic radiation 104 having the frequency F1.

The radome 106 (e.g., the wall 118 of the radome 106) may be constructed of a frequency selective material that is electromagnetically transparent (e.g., formed from the electromagnetically transparent material 122) to electromagnetic radiation 104 having the frequency F1 but electromagnetically opaque or reflective (e.g., formed from or covered by the electromagnetically reflective material 126) to electromagnetic radiation 104 having the frequency F2.

Thus, the window 108 in the radome 106 may affect the directionality of electromagnetic radiation 104 having the frequency F2 emitted by the antenna 102 enclosed within the radome 106 by limiting electromagnetic radiation 104 having the frequency F2 radiating from the radome 106 to the portion of which that passes through the window 108, in a substantially similar manner as described herein above.

Electromagnetic radiation 104 having the frequency F1 from any direction may pass through the radome 106 and be received by the antenna 102.

In another example embodiment, the system 100 may be configured to transmit electromagnetic radiation 104 having different frequencies (e.g., frequency F2 and frequency F3). In one example construction, the radome 106 having multiple windows 130 (e.g., window 130*a* and window 130*b* as best illustrated in FIGS. 14-17) may be configured to transmit electromagnetic radiation 104 having different frequencies in different directions based on the position of the windows 130 (e.g., based on the rotated position of the sections 128*a*, 128*b* of the radome 106) relative to the antenna 102. In one example construction, window 130*a* may be formed of a frequency selective material that is electromagnetically transparent to electromagnetic radiation 104 having frequency F2 and window 130*b* may be formed of a frequency selective material that is electromagnetically transparent to electromagnetic radiation 104 having the frequency F3.

The frequency selective material forming the radome 106 and/or the windows 130 may also serve as a lightning strike applique. As one example construction, the radome 106 (e.g., the wall 118 of the radome 106) may be constructed as a layered structure (not shown) having an external surface and an internal surface. For example, an external structural layer of the layered structure may be positioned proximate the external surface, an internal structural layer of the layered structure may be positioned proximate the internal surface, and a core layer of the layered structure may be positioned between the external structural layer and the internal structural layer. The external and internal structural layers may form the physical structure of the radome 106, while the core layer may contain a Faraday cage layer and/or artificial dielectric layers. Those skilled in the art will appreciate that variations to the general configuration (external structural layer—core layer—internal structural layer) of the layered structure may be made.

As one example, the artificial dielectric layers may be formed using any available technique for forming an artificial dielectric having an effective capacitance. Those skilled in the art will appreciate that the effective capacitance of the artificial dielectric layers may be a parameter that may be modified during the research and development phase to tune the radome 106 to a particular frequency band (e.g., frequency F1).

As one example, the Faraday cage layers may be formed from a lightning-resistant Faraday cage material such that the Faraday cage layers have an effective inductance. Those skilled in the art will appreciate that the effective inductance of the Faraday cage layers may be a parameter that may be selected (e.g., by appropriate material selection or design) during the research and development phase to tune the radome 106 to a particular frequency band. Any network of electrically conductive material in a continuous direct current path may suitably form a Faraday cage material. When the Faraday cage material is formed from a highly electrically conductive material (e.g., copper, silver or aluminum), and the basis weight and cross-sectional thickness of the Faraday cage material are of a sufficient magnitude, the Faraday cage material may become lightning-resistant, thereby rending the material suitable for use in the Faraday cage layers of the radome 106. A lightning-resistant Faraday cage material may allow lightning-induced (or EMP-induced) currents to flow along the material without significantly burning up the material, particularly at locations away from the lightning attachment location.

Example 1: Cylindrical Radome

Figure 20:
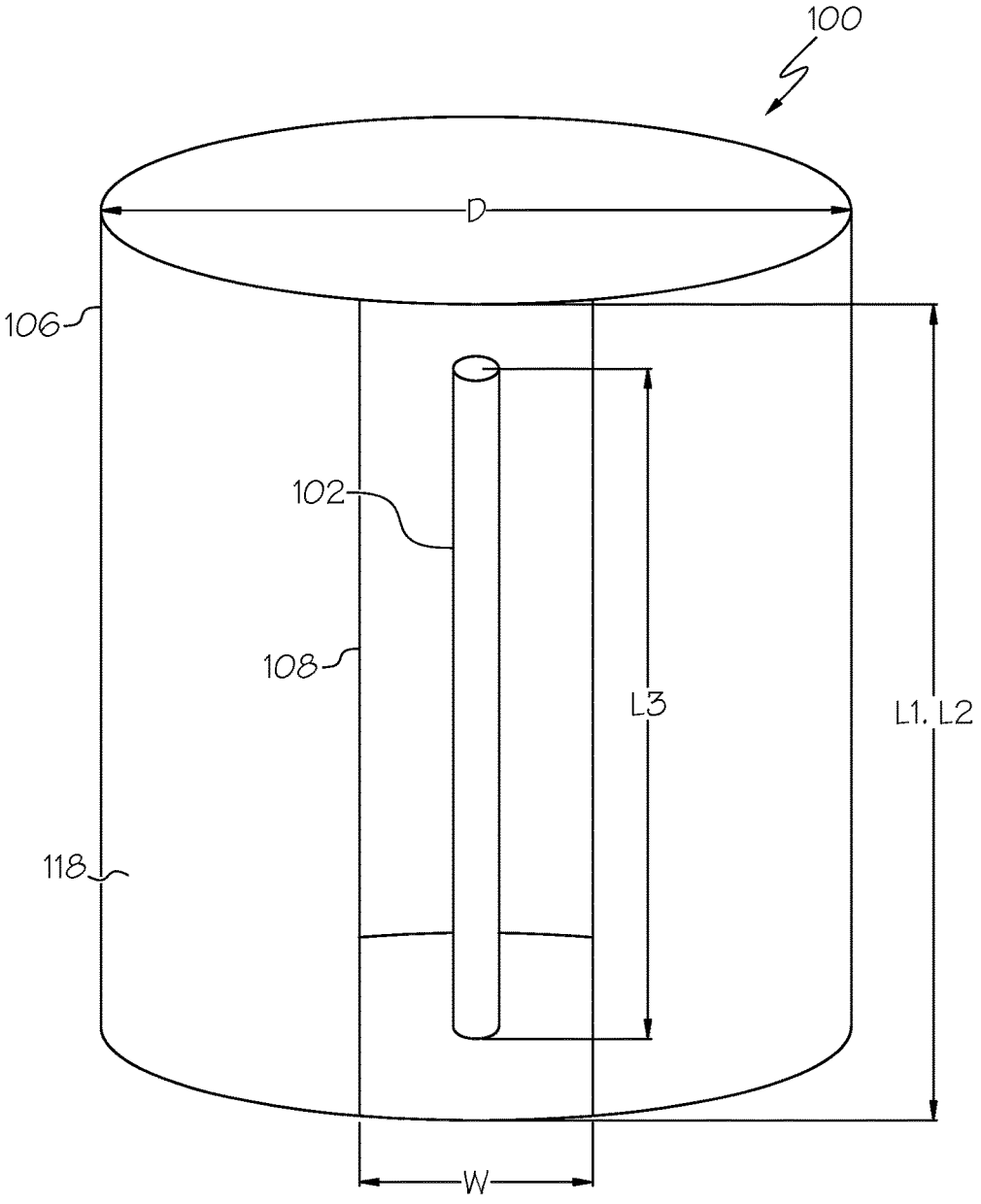
FIG. 20 is a schematic perspective view of another embodiment of the antenna electromagnetic radiation steering system of FIG. 1.

Referring to FIG. 20, one specific, non-limiting example of the disclosed system 100 may include a standard half-wavelength dipole antenna 102 in a substantially vertical orientation enclosed within a cylindrical radome 106. As used herein, "half-wave" means that the length of the dipole antenna is substantially equal to a half-wavelength of electromagnetic radiation (e.g., radio waves) emitted from the antenna 102 at the operating frequency. The antenna 102 may be positioned at substantially a center of the cylindrical radome 106.

A length L3 (e.g., vertical height) of the antenna 102 may be set to be (e.g., may be equal to) a half-wavelength of electromagnetic radiation 104 at the predetermined (e.g., desired) operating frequency. In this specific, non-limiting example, the length L3 of the antenna 102 may be approximately 3.9 inches and the operating frequency (e.g., of the system 100) may be approximately 1515 MHz (or 1.5 GHz).

The length L2 (e.g., vertical height) of the cylindrical radome 106 may be approximately 10 percent larger than the length L3 of the antenna 102. In this specific, non-limiting, the length L2 of the cylindrical radome 106 may be approximately 4.3 inches.

As one example construction, the diameter D of the cylindrical radome 106 may be greater than 1 wavelength. As another example construction, the diameter D of the cylindrical radome 106 may be greater than 3 wavelengths. As yet another example construction, the diameter D of the cylindrical radome 106 may be greater than 10 wavelengths. In this specific, non-limiting example, the diameter D of the cylindrical radome 106 may be approximately 6.6 inches and the circumference of the cylindrical radome 106 may be approximately 18 inches.

The width W of the window 108 may be proportional to the wavelength of electromagnetic radiation 104 emitted by the antenna 102. In this specific, non-limiting example, the width W of the window 108 may be ⅙ wavelength.

As used herein, a person of ordinary skill in the art will appreciated that the disclosed approximate dimensions illustrating the example constructions of the disclosed system 100 (e.g., the length L1 of the window, the width W of the window, the length L2 of the radome, the length L3 of the antenna 102, and/or the diameter D of the radome 106) may vary within manufacturing tolerances.

As used herein a person of ordinary skill would appreciate that the disclosed approximate operating frequencies illustrating the example implementations of the disclosed system 100 may vary by approximately 10 percent to 15 percent. For example, approximately 1515 GHz may be between approximately 1280 GHz and 1360 GHz.

Figure 21:
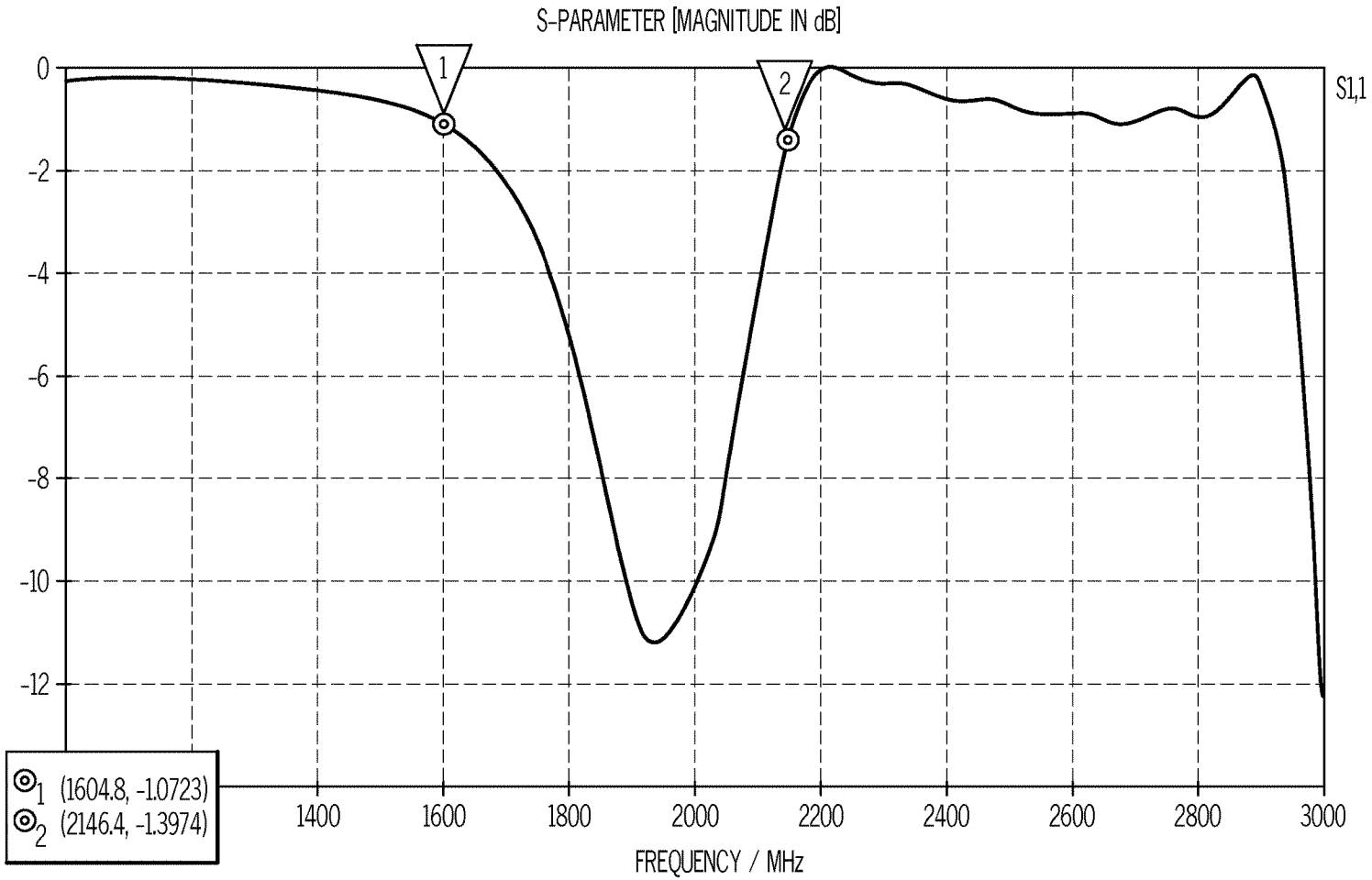
FIG. 21 is a graphical illustration of return loss vs. frequency of the antenna electromagnetic radiation steering system of FIG. 20.

FIG. 21 illustrates a simulated diagram of return loss vs. frequency of the system 100 in this specific, non-limiting example. The system 100 may have a reflective coefficient useful for radiation in the range of approximately 1600 MHz to 2150 MHz (or 1.6 GHz to 2.1 GHz).

Figure 22:
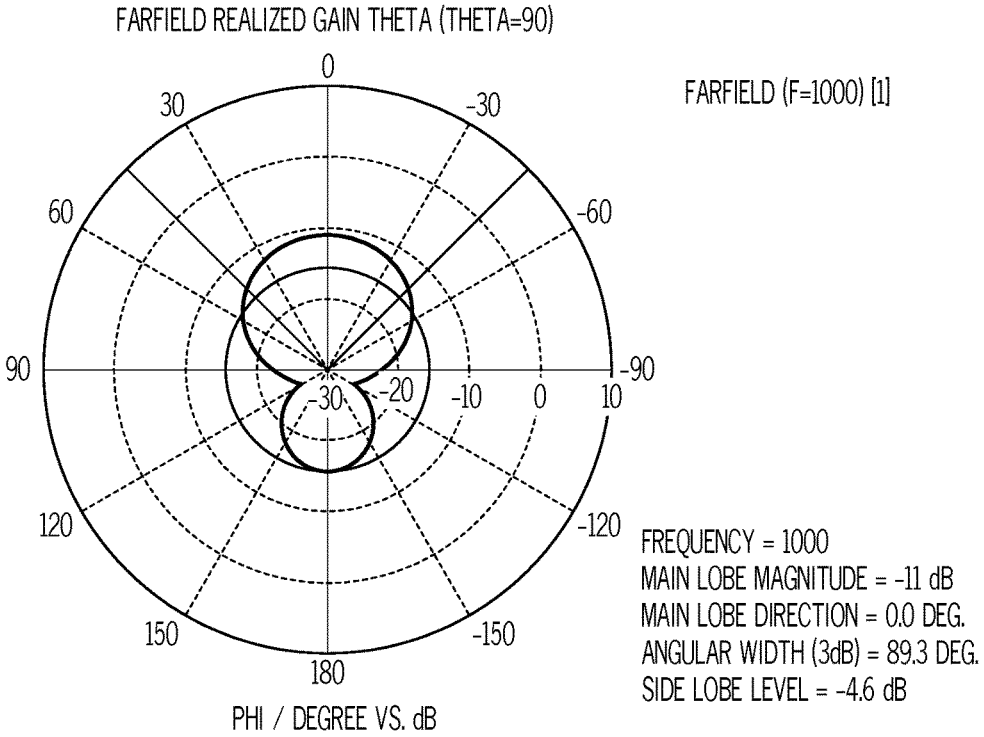
FIG. 22 is a graphical illustration of an azimuth polar radiation pattern according to one implementation of the antenna electromagnetic radiation steering system of FIG. 20.
Figure 23:
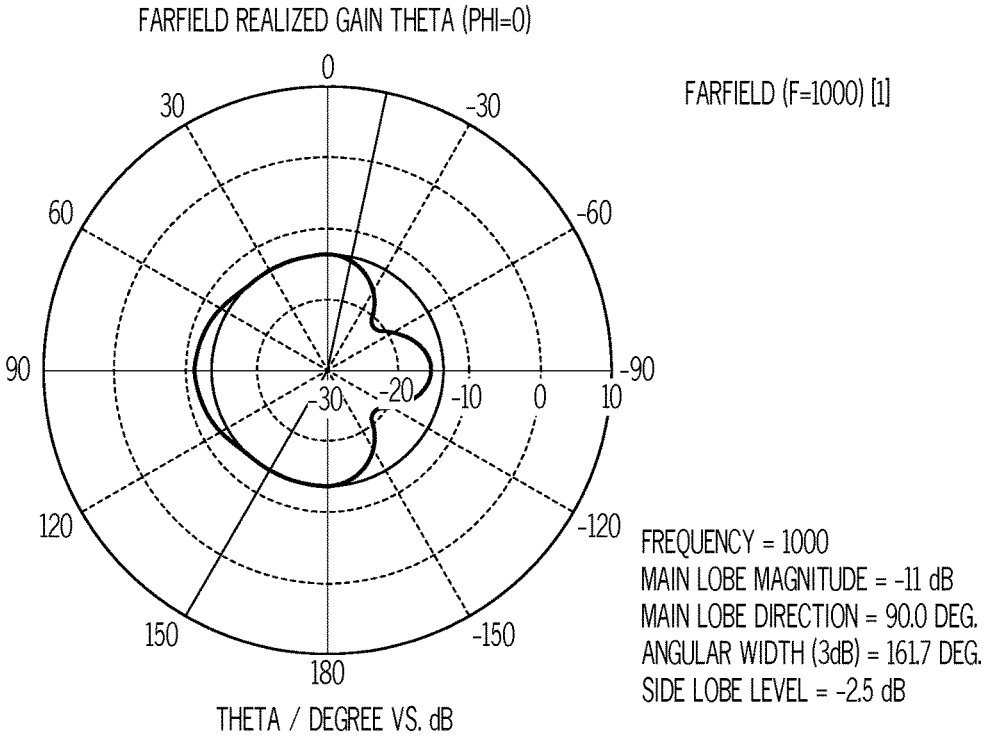
FIG. 23 is a graphical illustration of an elevation polar radiation pattern according to one implementation of the antenna electromagnetic radiation steering system of FIG. 20.

FIG. 22 illustrates one simulated azimuth polar radiation pattern of the system 100 in this specific, non-limiting example. FIG. 23 illustrates one simulated elevation polar radiation pattern of the system 100 in this specific, non-limiting example. The operating frequency of the system 100 is approximately 1000 MHz (or 1 GHz). The system 100 has approximately a 10 dB front-back gain ratio (e.g., the ratio of power gain between the front and rear of a directional antenna).

Figure 24:
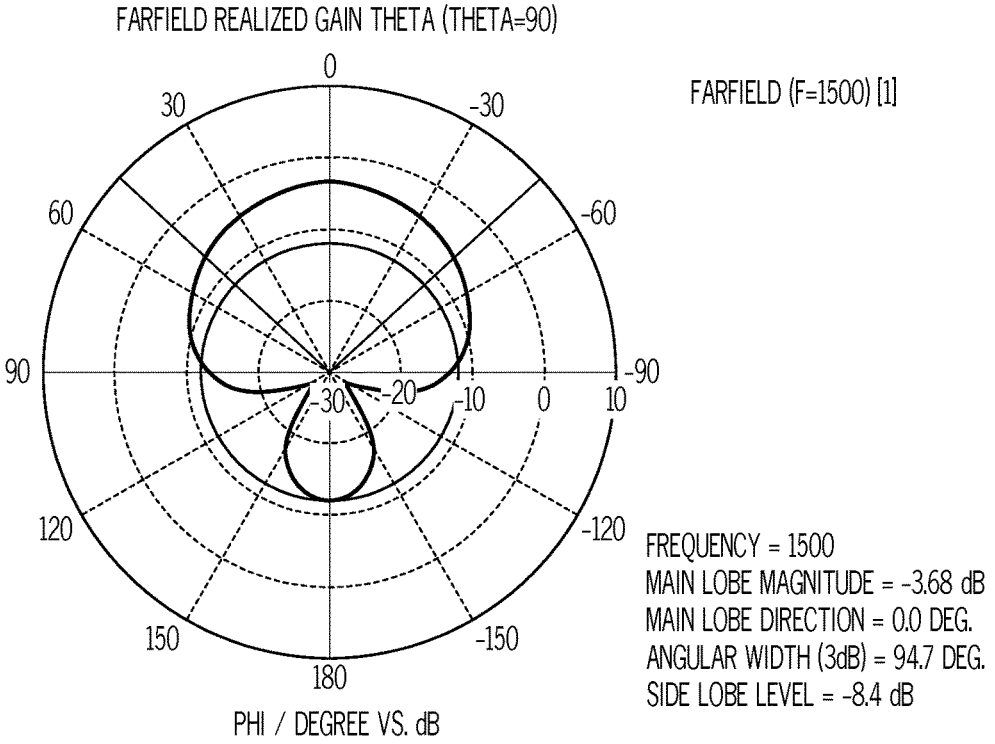
FIG. 24 is a graphical illustration of an azimuth polar radiation pattern according to another implementation of the antenna electromagnetic radiation steering system of FIG. 20.
Figure 25:
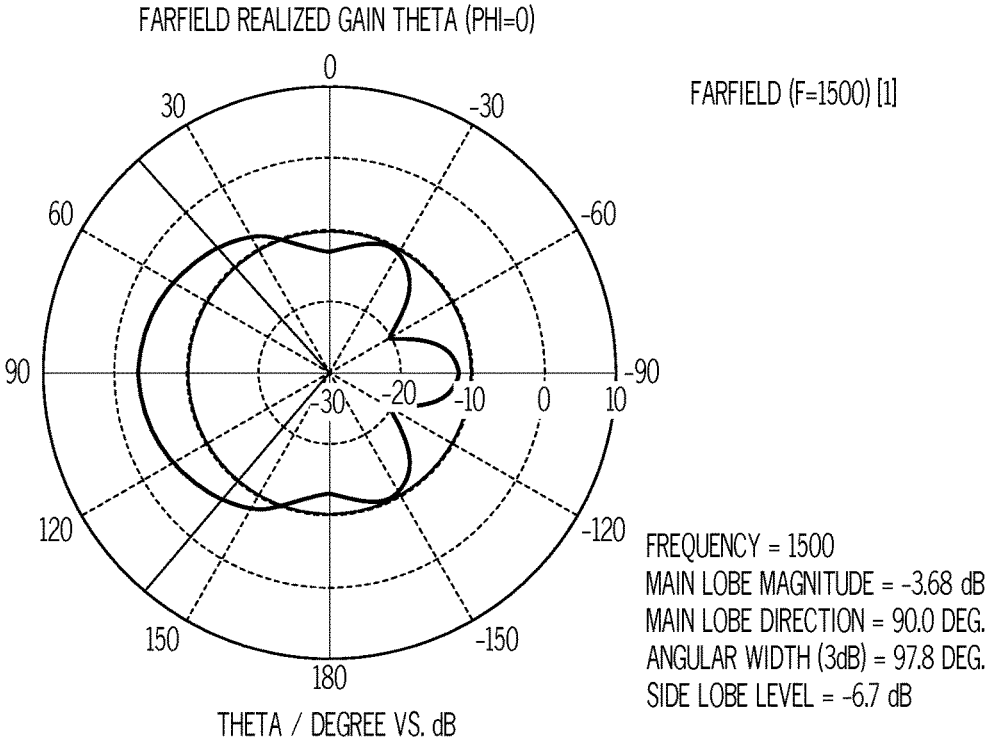
FIG. 25 is a graphical illustration of an elevation polar radiation pattern according to another implementation of the antenna electromagnetic radiation steering system of FIG. 20.

FIG. 24 illustrates another simulated azimuth polar radiation pattern of the system 100 in this specific, non-limiting example. FIG. 25 illustrates another simulated elevation polar radiation pattern of the system 100 in this specific, non-limiting example. The operating frequency of the system 100 is approximately 1500 MHz (or 1.5 GHz). The system 100 has approximately a 10 dB front-back gain ratio.

Figure 26:
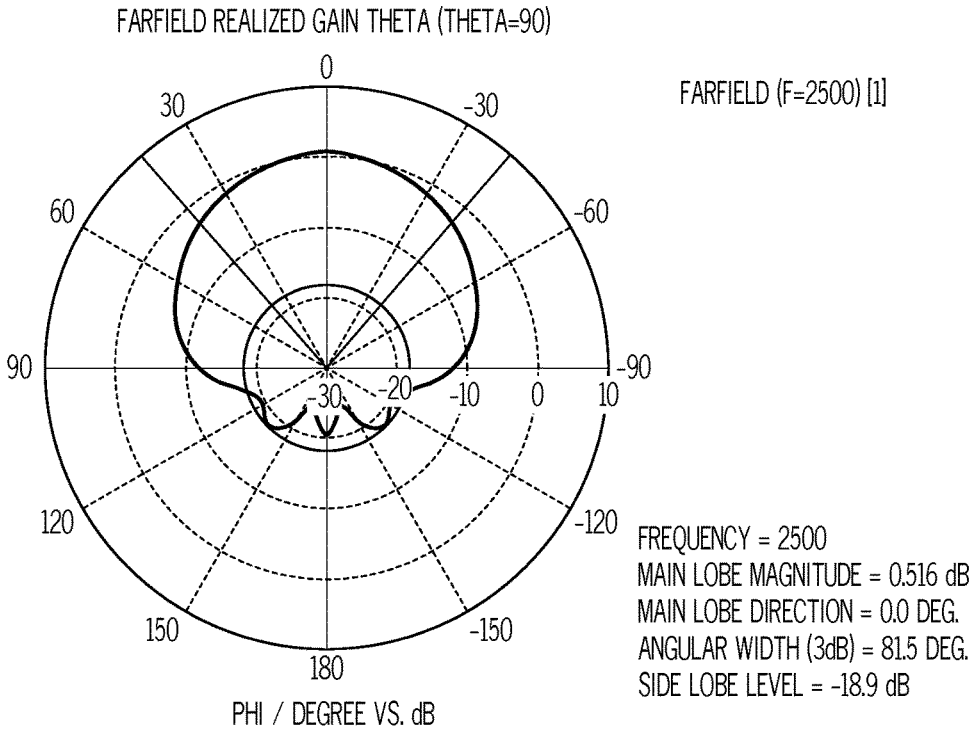
FIG. 26 is a graphical illustration of an azimuth polar radiation pattern according to another implementation of the antenna electromagnetic radiation steering system of FIG. 20.
Figure 27:
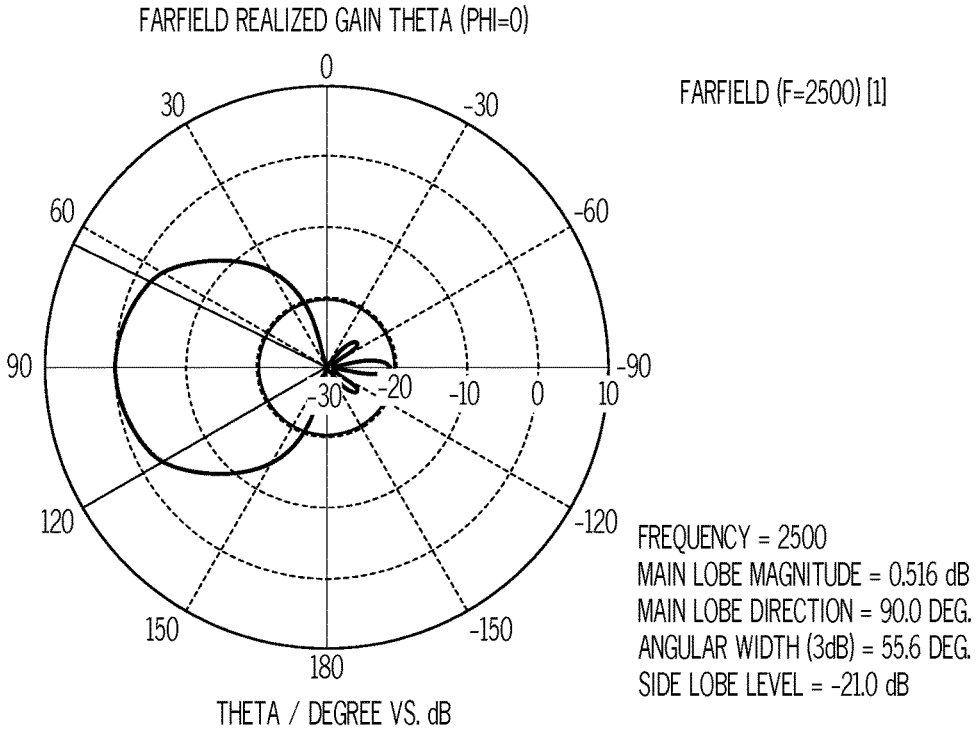
FIG. 27 is a graphical illustration of an elevation polar radiation pattern according to another implementation of the antenna electromagnetic radiation steering system of FIG. 20.

FIG. 26 illustrates another simulated azimuth polar radiation pattern of the system 100 in this specific, non-limiting example. FIG. 27 illustrates another simulated elevation polar radiation pattern of the system 100 in this specific, non-limiting example. The operating frequency of the system 100 is approximately 2000 MHz (or 2 GHz). The system 100 has approximately a 15 dB front-back gain ratio.

Example 2: Conical Radome

Figure 28:
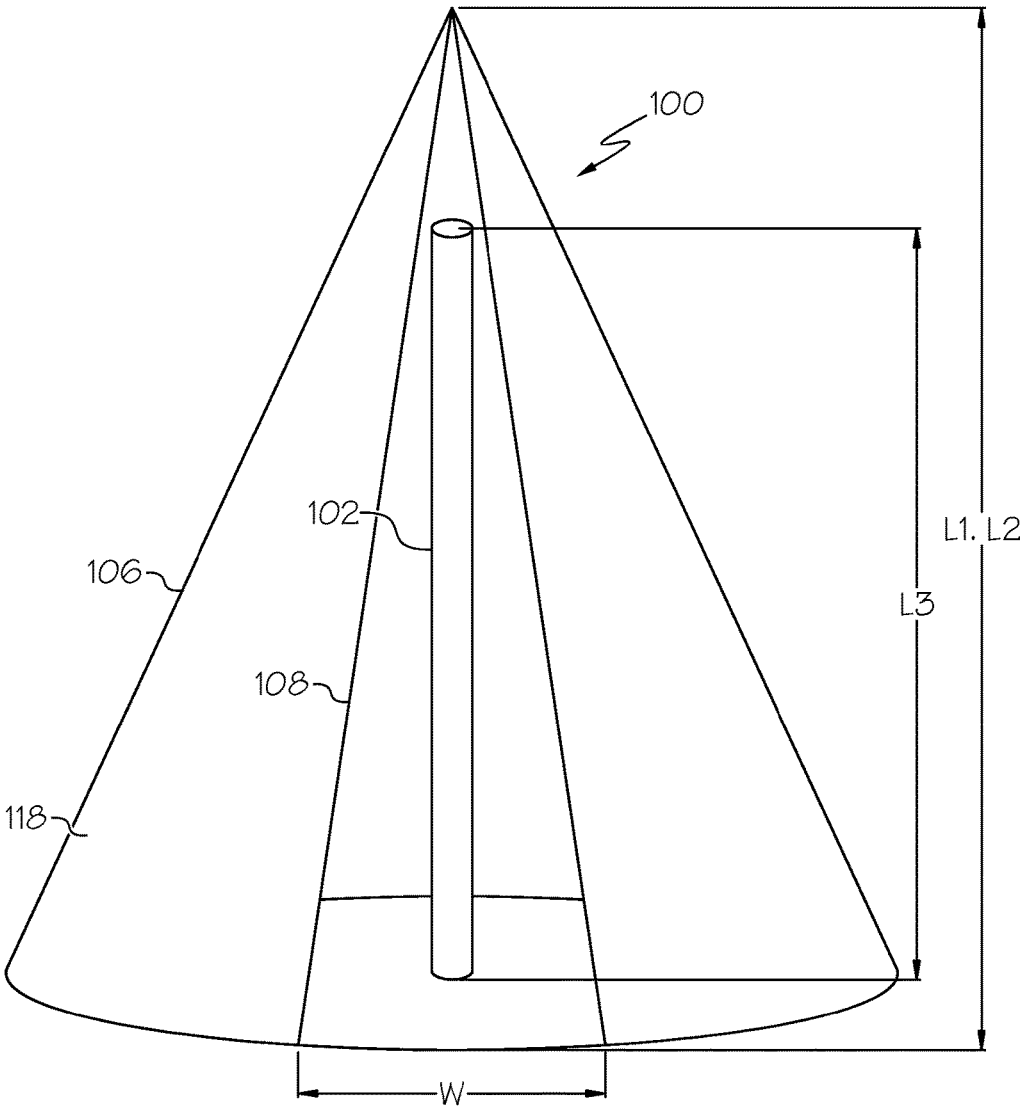
FIG. 28 is a schematic perspective view of another embodiment of the antenna electromagnetic radiation steering system of FIG. 1.

Referring to FIG. 28, another specific, non-limiting example of the disclosed system 100 may include a standard half-wavelength dipole antenna 102 in a substantially vertical orientation enclosed within a conical radome 106. The antenna 102 may be positioned at substantially a center of the conical radome 106.

The length L3 (e.g., vertical height) of the antenna 102 may be set to be (e.g., may be equal to) a half-wavelength of electromagnetic radiation 104 at the predetermined (e.g., desired) operating frequency. In this specific, non-limiting example, the length L3 of the antenna 102 may be approximately 3.9 inches and the operating frequency may be approximately 1515 MHz (or 1.5 GHz).

The length L2 (e.g., vertical height) of the conical radome 106 may be approximately 10 percent larger than the length L3 of the antenna 102. In this specific, non-limiting, the length L2 of the conical radome 106 may be approximately 4.3 inches.

As one example construction, the diameter (e.g., at the base) of the conical radome 106 may be greater than 1 wavelength. As another example construction, the diameter of the conical radome 106 may be greater than 3 wavelengths. As yet another example construction, the diameter of the conical radome 106 may be greater than 10 wavelengths. In this specific, non-limiting example, the diameter of the conical radome 106 may be approximately 6.6 inches and the circumference of the cylindrical radome 106 may be approximately 18 inches.

The width W of the window 108 (e.g., at the base) may be proportional to the wavelength of electromagnetic radiation 104 emitted by the antenna 102. In this specific, non-limiting example, the width W of the window 108 may be ⅛ wavelength. For example, the window 108 may form an approximately 45-degree sector of the conical radome 106 (e.g., of the wall 118 of the radome 106).

Figure 29:
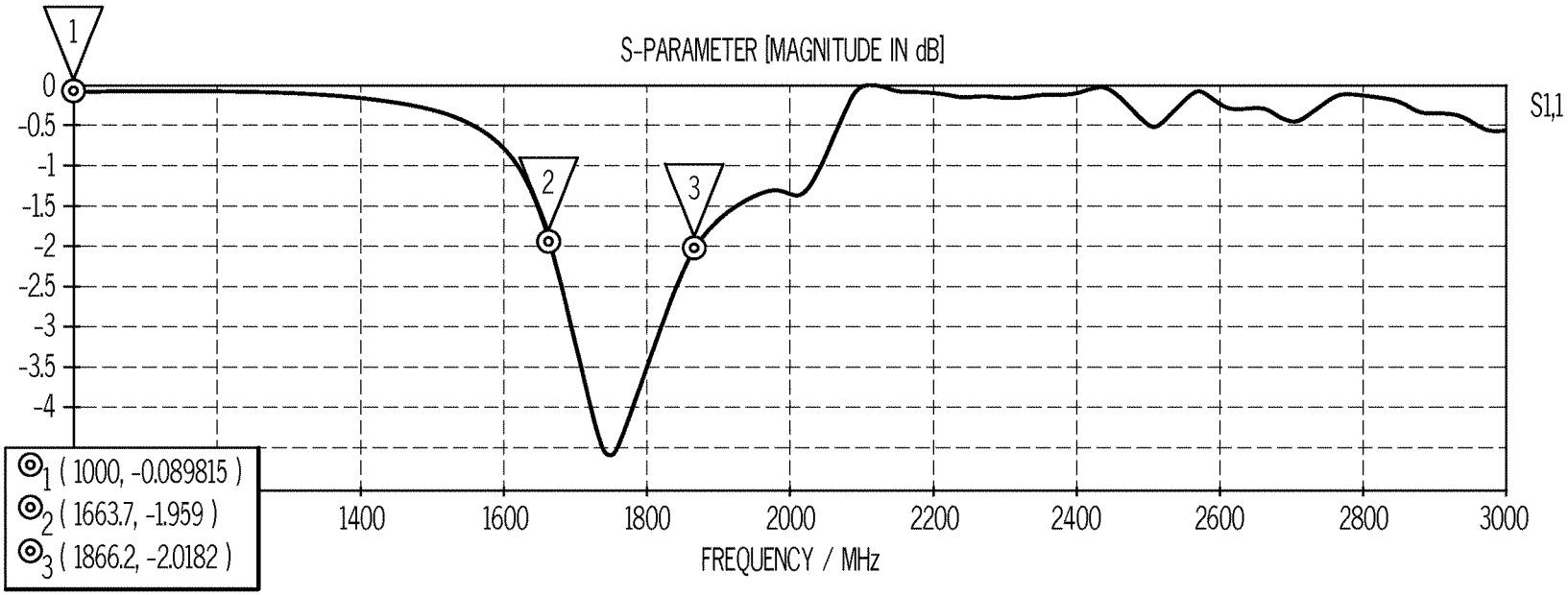
FIG. 29 is a graphical illustration of return loss vs. frequency of the antenna electromagnetic radiation steering system of FIG. 28.

FIG. 29 illustrates a simulated diagram of return loss vs. frequency of the system 100 in this specific, non-limiting example. The system 100 may have a reflective coefficient useful for radiation in the range of approximately 1650 MHz to 1850 MHz (or 1.6 GHz to 1.8 GHz).

Figure 30:
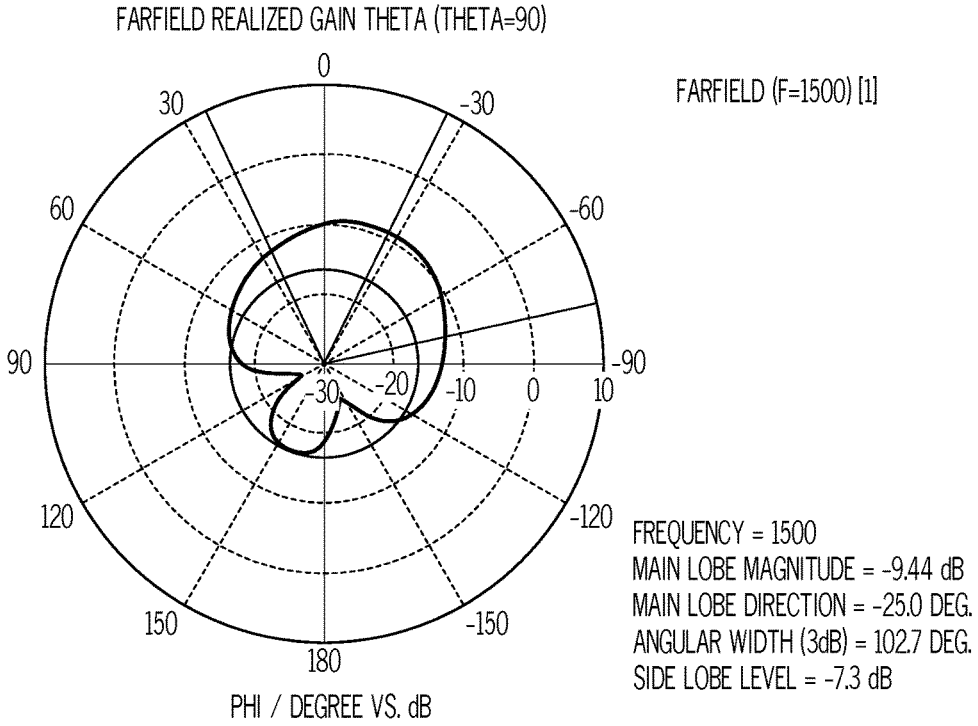
FIG. 30 is a graphical illustration of an azimuth polar radiation pattern according to one implementation of the antenna electromagnetic radiation steering system of FIG. 28.
Figure 31:
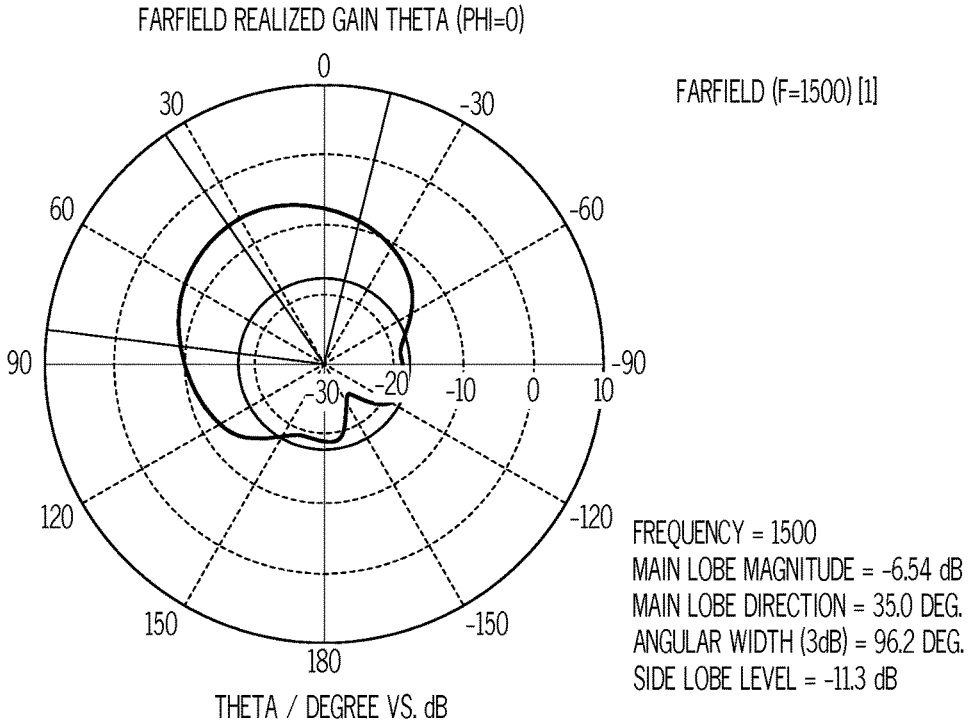
FIG. 31 is a graphical illustration of an elevation polar radiation pattern according to one implementation of the antenna electromagnetic radiation steering system of FIG. 28.

FIG. 30 illustrates one simulated azimuth polar radiation pattern of the system 100 in this specific, non-limiting example. FIG. 31 illustrates one simulated elevation polar radiation pattern of the system 100 in this specific, non-limiting example. The operating frequency of the system 100 is approximately 1500 MHz (or 1.5 GHz). The system 100 has approximately a 12 dB front-back gain ratio.

Figure 32:
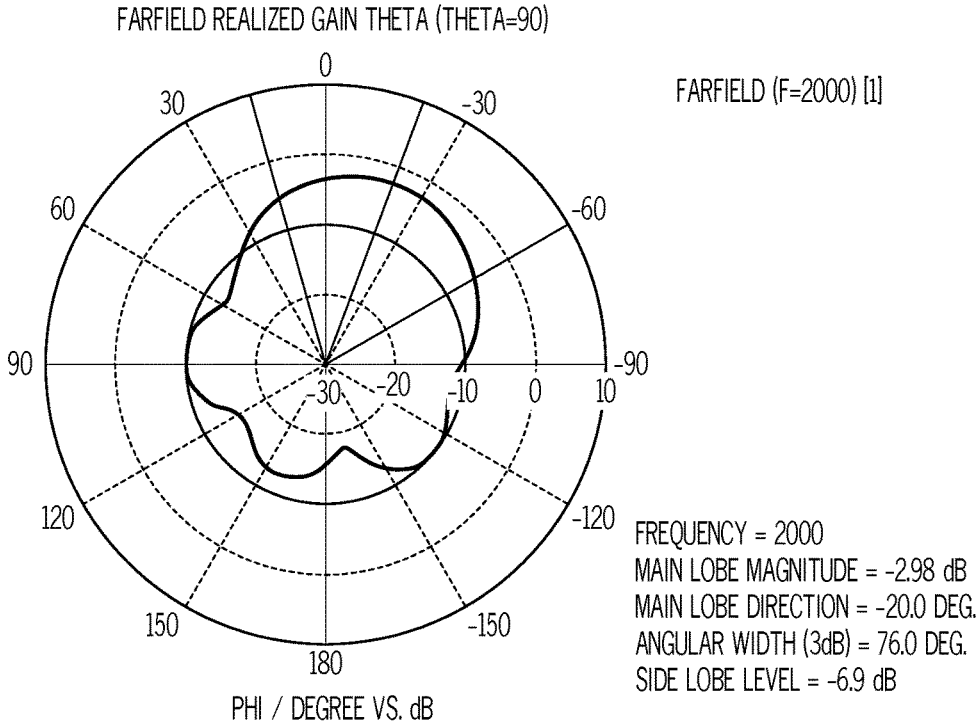
FIG. 32 is a graphical illustration of an azimuth polar radiation pattern according to another implementation of the antenna electromagnetic radiation steering system of FIG. 28.
Figure 33:
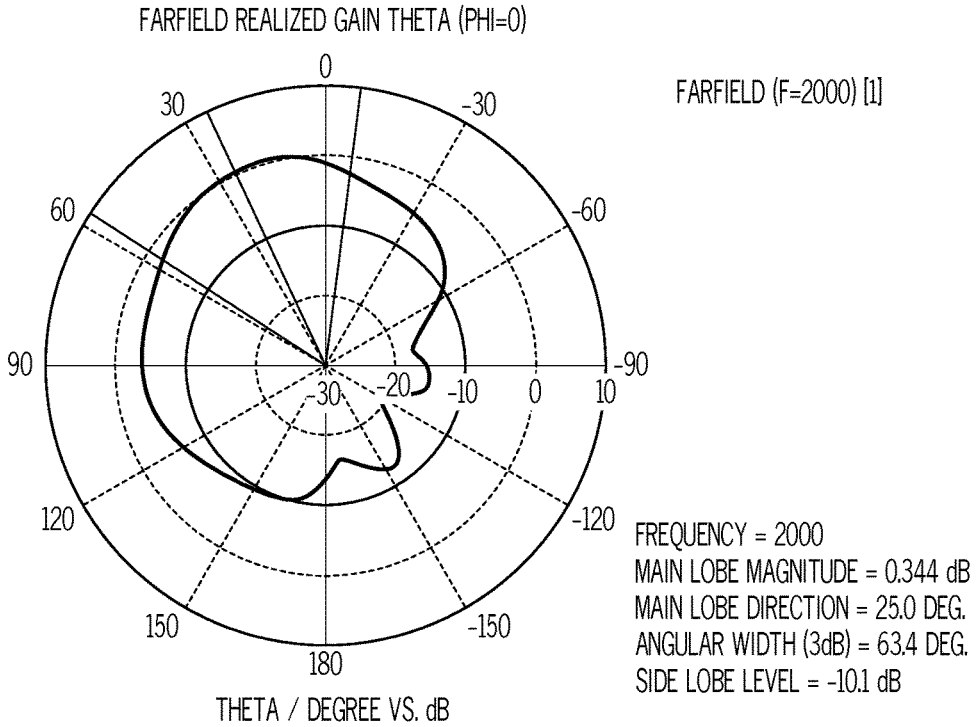
FIG. 33 is a graphical illustration of an elevation polar radiation pattern according to another implementation of the antenna electromagnetic radiation steering system of FIG. 28.

FIG. 32 illustrates another simulated azimuth polar radiation pattern of the system 100 in this specific, non-limiting example. FIG. 33 illustrates another simulated elevation polar radiation pattern of the system 100 in this specific, non-limiting example. The operating frequency of the system 100 is approximately 2000 MHz (or 2 GHz). The system 100 has approximately a 10 dB front-back gain ratio.

Figure 34:
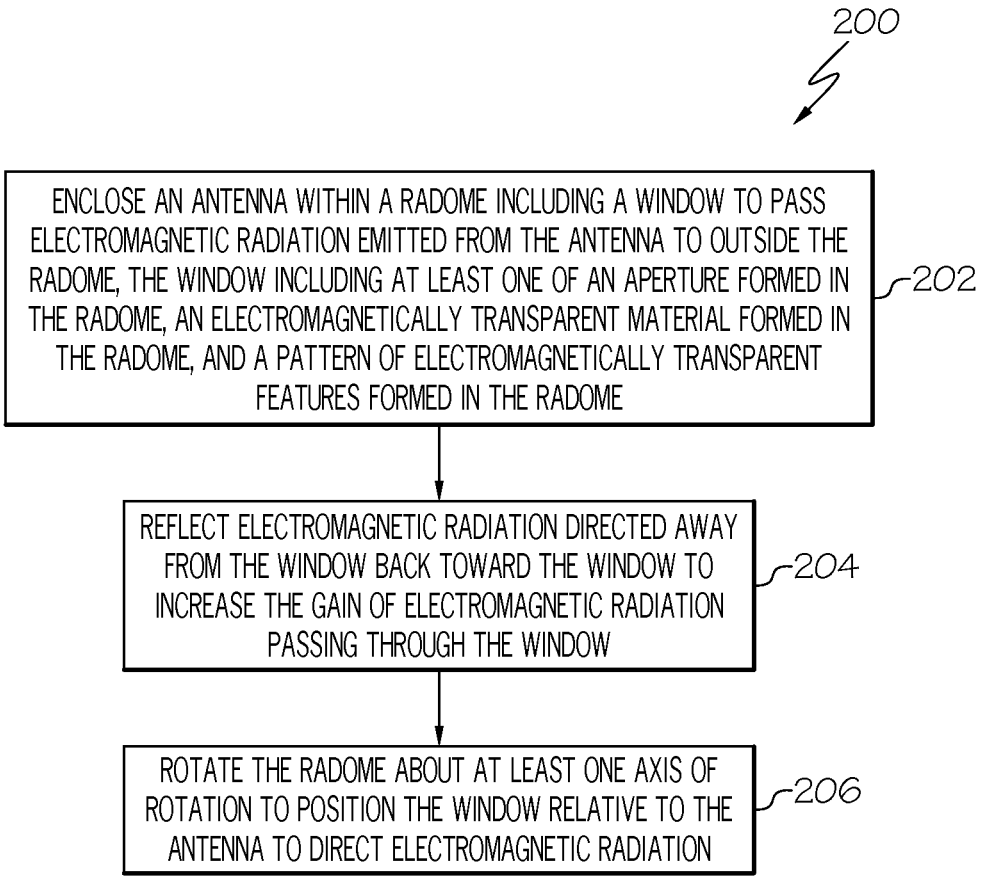
FIG. 34 is a flow diagram of one embodiment of the disclosed method for controlling a direction of electromagnetic radiation emitted from an omnidirectional antenna.

Referring to FIG. 34, one embodiment of the disclosed method, generally designated 200, for controlling a direction of electromagnetic radiation (e.g., radio waves) emitted from an antenna may begin by enclosing the antenna within a radome. The radome may include a window to pass the electromagnetic radiation from the antenna to outside the radome. The window may include at least one of an aperture (e.g., an absence of material) formed in the radome, an electromagnetically transparent material formed in the radome, and/or a pattern of electromagnetically transparent features (e.g., apertures and/or electromagnetically transparent material each having a two-dimensional shape) formed in the radome, as shown at block 202.

As shown at block 204, electromagnetic radiation directed away from the window may be reflected back toward the window by the radome (e.g., an electromagnetically reflective interior surface of the radome) to increase the gain of electromagnetic radiation passing through the window.

As shown at block 206, the radome may be rotated about at least one axis of rotation to position the window relative to the antenna to direct electromagnetic radiation.

Accordingly, the disclosed system and method may include an omnidirectional antenna enclosed within a radome having an electromagnetically transparent window to allow the antenna to radiate electromagnetic radiation in a predetermined direction based on the position of the window relative to the antenna. The radome with the electromagnetically transparent window may enhance the gain of the antenna enclosed within the radome. Thus, the disclosed system and method may transform a non-directional antenna into a directional antenna.

Although various embodiments of the disclosed system and method have been shown and described, modifications may occur to those skilled in the art upon reading the specification. The present application includes such modifications and is limited only by the scope of the claims.

What is claimed is:

1. An antenna electromagnetic radiation steering system comprising:

an omnidirectional antenna for emitting electromagnetic radiation; and a radome disposed adjacent to and at least partially enclosing said antenna, wherein said radome is electromagnetically opaque to said electromagnetic radiation and comprises a window to pass said electromagnetic radiation from said antenna to outside said radome, and wherein:

said antenna is stationary at a fixed position;

said radome is rotatable about at least one axis of rotation relative to said antenna said electromagnetic radiation is directed based on a rotated position of said window relative to said antenna; and said window has a width between ⅛ and ½ of a wavelength of said electromagnetic radiation.

2. The system of claim 1 wherein said window comprises an aperture in said radome.

3. The system of claim 1 wherein said window comprises an electromagnetically transparent material formed in said radome.

4. The system of claim 1 wherein said window comprises a pattern of electromagnetically transparent features.

5. The system of claim 4 wherein said electromagnetically transparent features comprise a two-dimensional geometry.

6. The system of claim 5 wherein said two-dimensional geometry is selected from one of a slot, a plus, a circle, an oval, a rectangle, a triangle, an ogive, a cross, a chicken-foot, an X, and a polygon.

7. The system of claim 4 wherein said electromagnetically transparent features each comprises one of an aperture in said radome or an electromagnetically transparent material formed in said radome.

8. The system of claim 1 wherein:

said electromagnetic radiation is a first electromagnetic radiation having a first frequency;

said window is electromagnetically transparent to said first electromagnetic radiation having said first frequency; and said radome is electromagnetically transparent to a second electromagnetic radiation having a second frequency different that said first frequency.

9. The system of claim 1 wherein said radome comprises a length and said antenna comprises a length, wherein said length of said radome is 10 percent greater than said length of said antenna.

10. The system of claim 9 wherein said window comprises a length, and wherein said length of said window is approximately equal to said length of said radome.

11. The system of claim 1 wherein said radome comprises at least two sections, each section comprising a window to pass said electromagnetic radiation from said antenna to outside said radome, and wherein said electromagnetic radiation is directed based on a position of said window of said section relative to said antenna.

12. The system of claim 11 wherein said each section is independently rotatable about an axis of rotation.

13. The system of claim 1 wherein an inner surface of said radome is electromagnetically reflective to said electromagnetic radiation.

14. A radome comprising:

a radome wall at least partially enclosing a stationary omnidirectional antenna, wherein said radome wall is electromagnetically opaque to prevent electromagnetic radiation from passing through said radome wall;

a window formed in said radome wall, wherein said window is electromagnetically transparent to pass said electromagnetic radiation through said radome; and a radome drive mechanism to rotate said radome wall about at least one axis of rotation relative to said antenna, wherein said electromagnetic radiation is directed based on a rotated position of said window relative to said antenna.

15. The radome of claim 14 wherein said window comprises at least one of an aperture formed in said radome wall, an electromagnetically transparent material formed in said radome wall, and a pattern of electromagnetically transparent features formed in said radome wall.

16. The radome of claim 14 wherein said window comprises a width, and wherein said width of said window is between ⅛ and ½ of a wavelength at an operating frequency of said electromagnetic radiation.

17. The radome of claim 14 wherein said radome wall comprises a shape defining an interior volume sufficient to enclose said antenna, and wherein said shape of said interior volume is selected from one of a cylinder, a sphere, a semi-sphere, a cone, and a pyramid.

18. The radome of claim 14 wherein said window comprises a width, and wherein said width of said window is proportional to a frequency of said electromagnetic radiation.

19. The radome of claim 18 wherein said width of said window is between ⅛ and ½ of a wavelength at said frequency.

20. A method for controlling a direction of electromagnetic radiation emitted from an omnidirectional antenna, said method comprising:

fixing said antenna in a stationary position;

enclosing said antenna within an electromagnetically opaque radome comprising an electromagnetically transparent window to pass said electromagnetic radiation from said antenna to outside said radome, said window comprising at least one of an aperture formed in said radome, an electromagnetically transparent material formed in said radome, and a pattern of electromagnetically transparent features formed in said radome;

reflecting electromagnetic radiation directed away from said window back toward said window to increase a gain of said electromagnetic radiation passing through said window;

rotating said radome about at least one axis of rotation to position said window relative to said antenna; and directing said electromagnetic radiation based on a rotated position of said window relative to said antenna.

* * * * *